US005975528A

United States Patent [19]

Halaby

[11] Patent Number: 5,975,528

[45] Date of Patent: Nov. 2, 1999

[54] INNOVATIVE GAMING APPARATUS

[76] Inventor: Josef E. Halaby, 201 W. California Ave., Sunnyvale, Calif. 94086

[21] Appl. No.: 08/608,181

[22] Filed: Feb. 28, 1996

[51] Int. Cl.[6] ..... A63F 9/22

[52] U.S. Cl. ..... 273/148 K; 463/13; 463/25; 273/309

[58] Field of Search ..... 463/25, 30, 31, 463/34, 13; 273/274, 148 R, 309

[56] References Cited

U.S. PATENT DOCUMENTS

| | | |
|---|---|---|
| 5,200,890 | 4/1993 | Pionchon . |
| 5,221,083 | 6/1993 | Dote . |
| 5,299,803 | 4/1994 | Halaby . |
| 5,451,054 | 9/1995 | Orenstein . |

OTHER PUBLICATIONS

FortuNet, Inc PONGO game brochure, 1995.

*Primary Examiner*—Michael O'Neill

[57] ABSTRACT

A wagering method is disclosed according to which players using an automated gaming table may:

compete against a common dealer for win/lose status while wagering against each other, the amount wagered by all losing players in a game being automatically transferred to a bank from which all winning players are automatically paid; or wager and compete against each other for position, with the highest ranked players automatically getting paid in descending order, from the amount wagered by the lowest ranked players in ascending order; or wager and compete for win/lose status against a bank representing a selected banker, with the provision to automatically provide to other players, the option of becoming associates in said bank, according to an automatic selection process or priority order; or compete against a bank representing one or more players, with the provision to automatically adjust the amount in the bank to the level of the amount wagered against it by automatically transferring the amount or part of the amount wagered by one or more players into said bank and making said player or players associates in said bank, when said player or players have selected the option of becoming associate bankers, said associate banker or bankers being automatically selected according to an established selection sequence.

Such methods employ an apparatus adapted for using computer-generated graphic likeness of poker chips controlled by manually operated switches to make wagers.

16 Claims, 25 Drawing Sheets

INNOVATIVE GAMING APPARATUS

FIELD OF INVENTION

This invention relates to the method of wagering in a table type game such as Blackjack or Poker, and more particularly to a method that allows players to individually compete against a common dealer for win/lose status while wagering against each other, to wager and compete against each other for ranking position, or to individually wager and compete against a bank representing one or more players, and to apparatus adapted for using computer-generated graphic likeness of poker chips controlled by manually operated switches to make wagers.

BACKGROUND

Card games such as Blackjack are known in which players individually make wagers against a bank. Such popular games are generally not legal in many parts of the country because of the unfair advantage that the banker has over the players.

Other card games are known in which players individually make wagers against a bank representing one or more of said players. One of the players is generally selected to act as primary banker for said bank for each game, according to a banker rotation sequence. The selected banker generally makes a substantial wager in said bank. One or more other players may elect to act as secondary bankers and also make a wager in said bank. There is generally no correlation between the amount wagered in the bank and the amount wagered against it.

In such games, poker chips or coins are generally used for wagering. Automated gaming tables are also known in which adjustable stacks of chips embedded into the table are electronically controlled to move vertically to indicate chips wagered and won by the players. Such automated gaming table is described in my U.S. Pat. No. 5,299,803, issued on Apr. 8, 1994.

BRIEF SUMMARY OF INVENTION

It is an object of the invention to provide a gaming method that allows players to individually compete against a common dealer for win/lose status while wagering against each other, the amount wagered by all losing players in a game being automatically transferred to a bank from which all winning players are automatically paid.

It is another object of the invention to provide a gaming method that allows players to wager and compete against each other for ranking position, with the highest ranked players automatically getting paid, in descending order, from the amount wagered by the lowest ranked players, in ascending order.

It is still an object of the invention to provide a gaming method that allows players to wager against a bank representing one or more players, with the provision to automatically transfer the amount wagered against said bank by one or more players into said bank in order to balance the amount in said bank with the amount wagered against it, when said player or players have selected the option of becoming associate bankers under certain conditions.

Still another object of the invention is to provide a method of the above-mentioned types according to which the amount or portion of the amount lost by the losing players that is not won by the winning players is automatically refunded to said losing players.

Yet another object of the invention is to provide a method of the above-mentioned types according to which the amount won/lost by a winning/losing player is proportional to the amount wagered by said winning/losing player and/or inversely proportional to the amount wagered by all other winning/losing players.

A further object of the invention is to provide a method of the above-mentioned types which employs an automated gaming table comprising a video monitor means on which computer-generated graphic likeness of poker chips are displayed to indicate chips wagered and won by players.

Yet a further object of the invention is to provide a gaming table of the above-mentioned type in which said video monitor means is graphically divided into display sections associated with each of said players, each of said display sections being further subdivided into sections on which chips wagered and chips won are respectively displayed.

Still a further object of the invention is to provide a gaming table of the above-mentioned type in which manually operated switch means associated with the players allow each of said players to place a bet and select other gaming options.

Finally it is another object of the invention to provide a gaming table of the above-mentioned type in which electronic control means monitor the amount wagered by each player and determine the amount won or lost by each player, based on the win/lose selection made for each said player and the gaming options selected.

In achieving the above and other objects of the invention, there is proposed an automated gaming table comprising numeric display means located generally in front of the players to indicate chips belonging to them, a computer adapted to generate graphic likeness of poker chips, a video monitor located generally at the center of the table and functionally divided into display sections associated with said players and a dealer, on which said likeness of poker chips and game operational data are respectively displayed, manually operated switch means generally located in front of the players that allow said players to place a wager, and manually operated switch means located generally in front of said dealer that allow said dealer to select winners and losers for each game.

Said numeric display means, computer means, video monitor means, player-associated switch means, dealer-associated switch means are connected in such a way that; when a player activates a switch to place a bet, graphic likeness of poker chips corresponding to the amount wagered are displayed on the bet column within the video section associated with said player, while the amount wagered is indicated in the numeric display means associated with said player; and when the dealer activates a switch to make a win/lose selection for a player, graphic likeness of poker chips corresponding to the amount won are displayed on the win column within the video section associated with said player, or the graphic likeness of poker chips displayed on the bet column within the video section associated with said player are decreased by a number of chips corresponding to the amount lost, while the amount won or lost is indicated in the numeric display means associated with said player.

There is further proposed special custom software to be loaded into the computer for operating the various components of the table to achieve the objectives set forth above.

DETAILED DESCRIPTION

As stated hereinabove, the invention provides a table for gaming which comprises first means defining a plurality of numeric display means indicating chips belonging to individual players, second means defining a plurality of switch means that allow said players to wager said chips, third means defining a video monitor means on which graphic likeness of poker chips are displayed to indicate chips wagered and won by said players, fourth means defining a computer means that generates and controls the display of said graphic likeness of poker chips, and fifth means defining a plurality of switch means that allow a designated dealer to select winners/losers for each game, sell/purchase chips to and from players, and select other gaming options.

Figure 1:
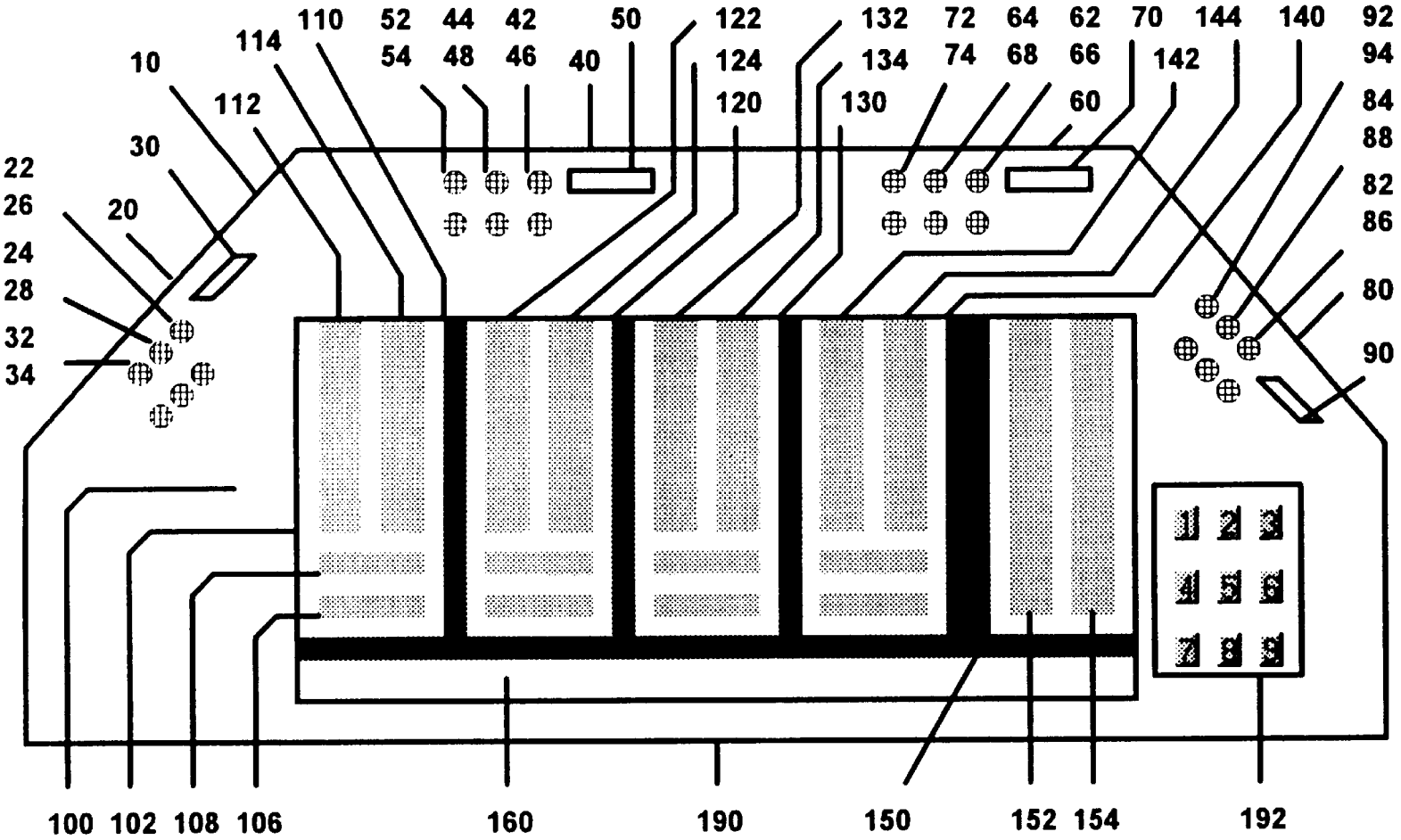
FIG. 1 is a perspective view of a gaming table provided with a video monitor for displaying graphic likeness of poker chips, and manually operated switch means for manipulating the chips in accordance with an embodiment of the invention.

In the drawing, the table construction illustrated in FIG. 1 comprises a tabletop 10 which is functionally divided into sections 20, 40, 60 and 80 defining the area allocated to some first, second, third and fourth players respectively, section 100 defining an area common for all players, and section 190 defining an area allocated for a designated dealer.

Tabletop sections 20, 40, 60 and 80 contain numeric display modules 30, 50, 70 and 90 that display the number of chips associated with said first, second, third and fourth players respectively, manually operated switches 22, 42, 62 and 82 that allow said first, second, third and fourth players to wager one chip of low denomination respectively, manually operated switches 26, 46, 66 and 86 that allow said first, second, third and fourth players to decrease their bet by one chip of low denomination respectively, manually operated switches 24, 44, 64, and 84 that allow said first, second, third and fourth players to wager one chip of higher denomination respectively, manually operated switches 28, 48, 68, and 88 that allow said first, second, third and fourth players to decrease their bet by one chip of higher denomination respectively, manually operated switches 32, 52, 72 and 92 that allow said first, second, third and fourth players to select a banking option for certain games respectively, and LED's 34, 54, 74 and 94 that indicate when said first, second, third and fourth players have selected a banking option respectively.

Tabletop section 100 contains a video monitor 102 which is graphically divided into sections 110, 120, 130, 140 which are associated with said first, second, third and fourth players respectively, section 150 which is associated with a bank, and section 160 which is associated with the dealer. Section 110 contains graphic vertical columns 112 and 114 which are composed of display columns 1–4 and 6–9 respectively, section 120 contains graphic vertical columns 122 and 124 which are composed of display columns 18–21 and 23–26 respectively, section 130 contains graphic vertical columns 132 and 134 which are composed of display columns 35–38 and 40–43 respectively, section 140 contains graphic vertical columns 142 and 144 which are composed of display columns 52–55 and 57–60 respectively, and section 150 contains graphic vertical columns 152 and 154 which are composed of display columns 69–72 and 74–77 respectively.

Display columns 112, 122, 132, and 142 are allocated for the display of graphic likeness of poker chips wagered by said first, second, third and fourth players respectively, while display columns 114, 124, 134 and 144 are allocated for the display of graphic likeness of poker chips won by said first, second, third and fourth players respectively. Display columns 152 and 154 are allocated for the display of graphic likeness of chips wagered or temporarily stored in the bank.

In display columns 112, 114, 122, 124, 132, 134, 142, 144, 152 and 154, rows 23–24 are allocated for the display of the first graphic likeness of chips in said columns, and rows 21–22, 19–20, 17–18, 15–16, 13–14, 11–12, 9–10, 7–8, 5–6 are allocated for the display of the second, third, fourth, fifth, sixth, seventh, eighth, ninth and tenth graphic likeness of chips in said columns respectively Two different graphic likeness of chips may be displayed in display columns 112, 114, 122, 124, 132, 134, 142, 144, 152 and 154: blue chips which are generally assigned a monetary value suitable for the game being played, and red chips which are assigned a higher monetary value that is perhaps 5 to 10 times the value of the blue chips.

Row 4 within sections 110, 120, 130 and 140 is allocated for the display of a symbol indicating a win, lose or tie selection for said first, second, third and fourth players respectively; it is indicated by line 106.

Row 3 within sections 110, 120, 130, and 140 is allocated for the display of a number or strings of vertical lines emulating a level meter that indicates the number of chips that said first, second, third and fourth players own respectively; it is indicated by line 108

Tabletop section 190 contains keyboard 192 that allows the designated dealer to select game parameters and perform game related functions.

Figure 2:
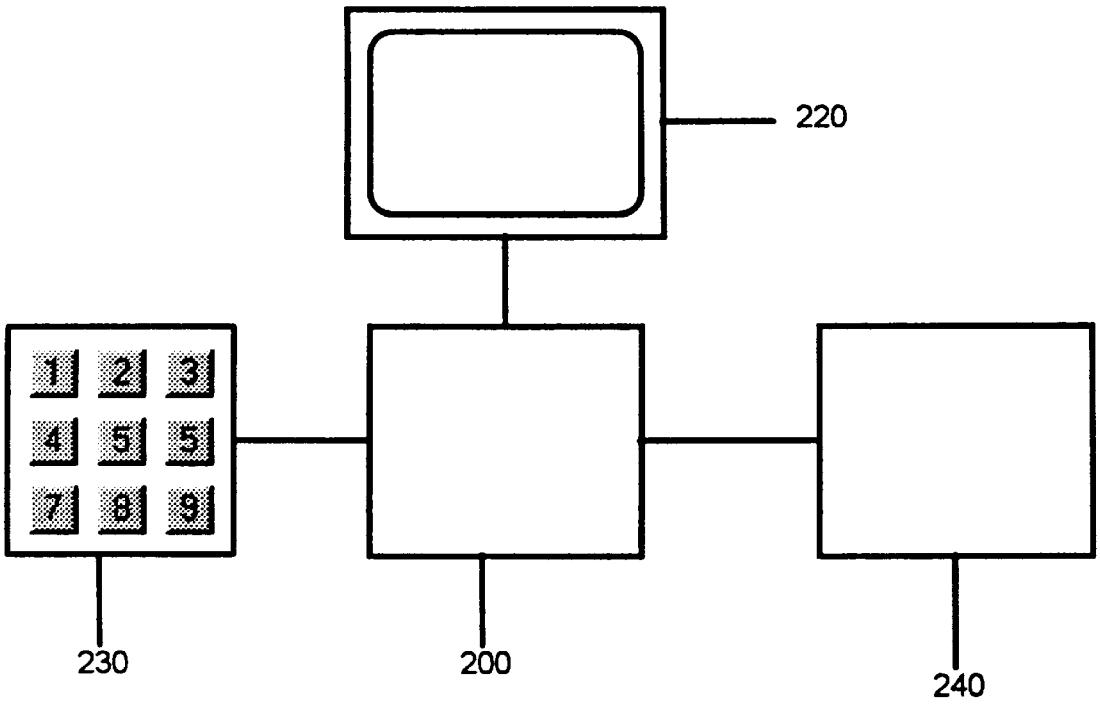
FIG. 2 is a block diagram of the electronic control system that controls and monitors the components incorporated within the gaming table.

FIG. 2 illustrates the PC-based data acquisition and control system that monitors and controls all the active components incorporated within the gaming table. It is composed of personal computer or CPU card 200, monitor 220, keyboard 230, and I/O card 240.

The input lines of I/O card 240 detect the contact closure of the manually operated switches associated with the players. The output lines control the operation of the LCD displays and LED's associated with said players.

The software that operates the system is booted into the personal computer or loaded into the ROM of the CPU card. Keyboard 192 preferably contains only the keys that are useful to the designated dealer to make game selections for the menu-driven program. Data acquisition and control system comprising I/O cards are conventional and need no further clarification in this text.

Figure 3:
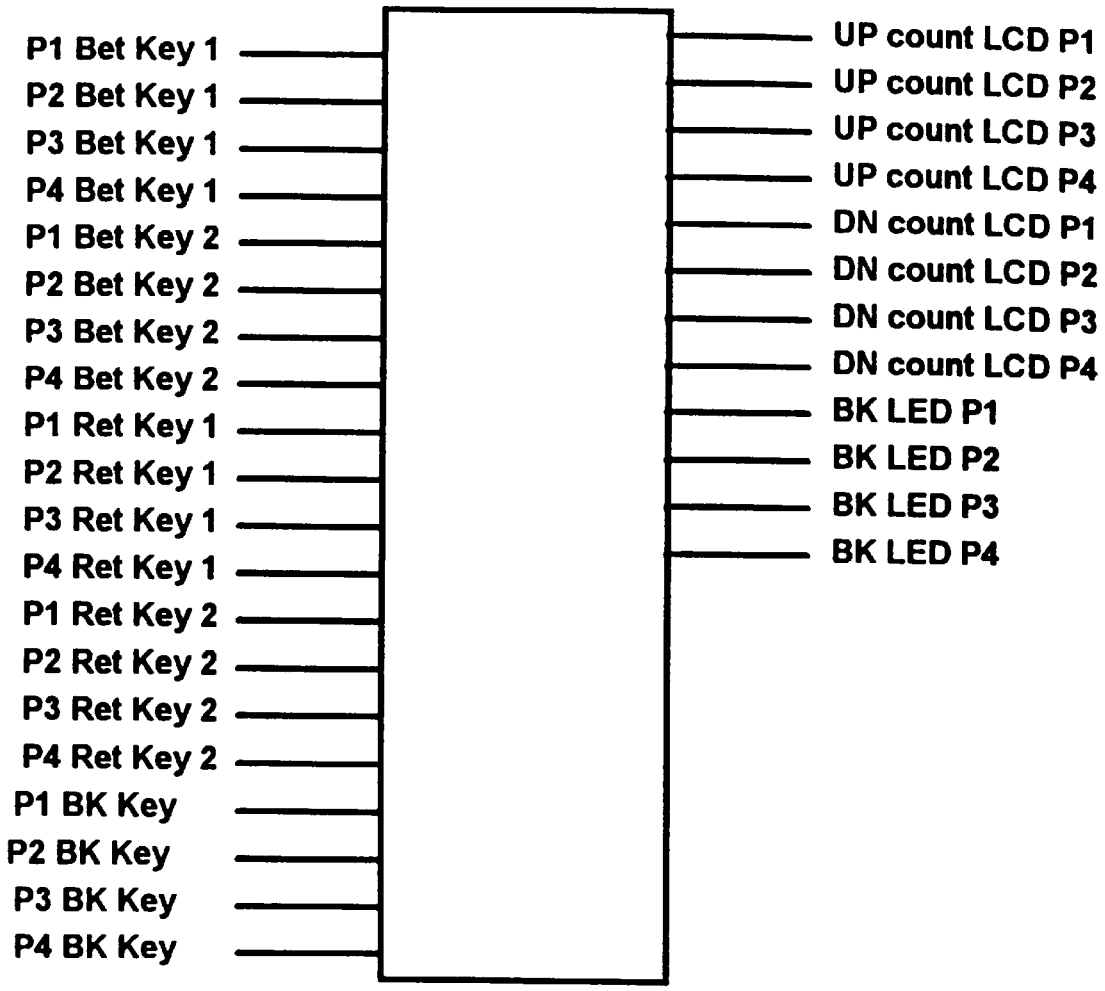
FIG. 3 is a block diagram illustrating the electrical connections of the components of the system to the electronic control system referred to in FIG. 2.
Figure 4:
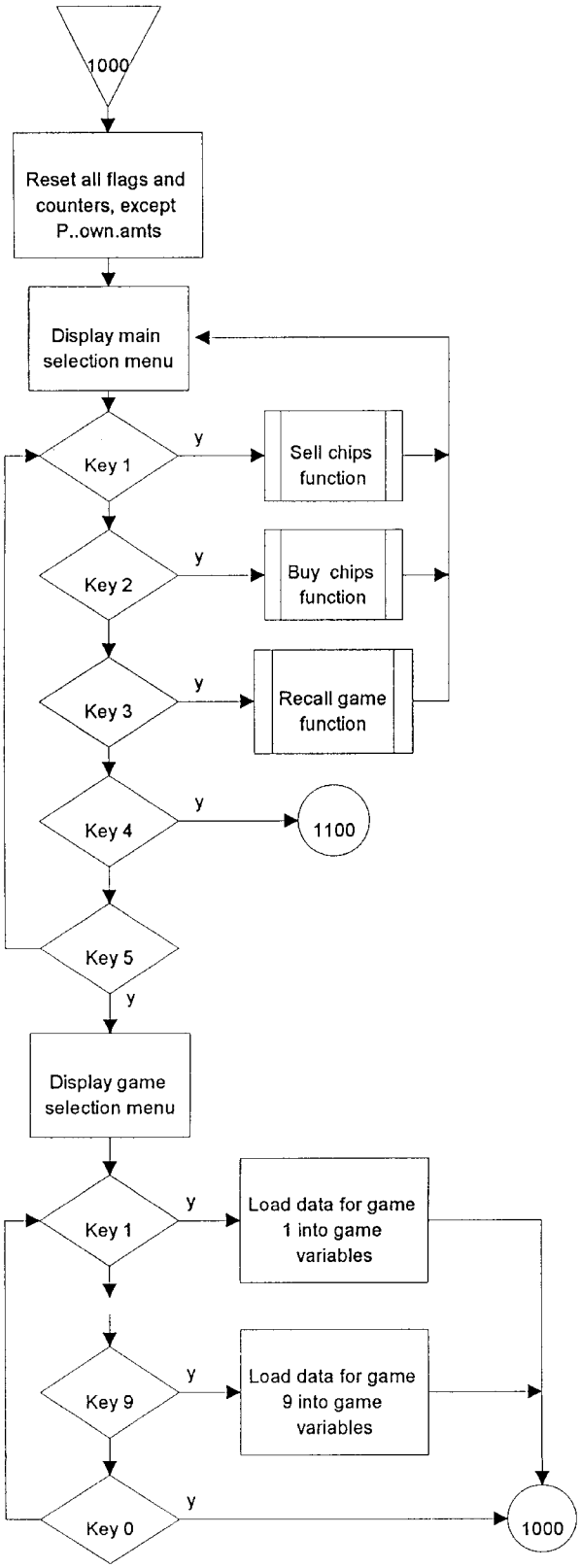
FIGS. 4 through 25 are flowcharts of the operations of the invention.
Figure 5:
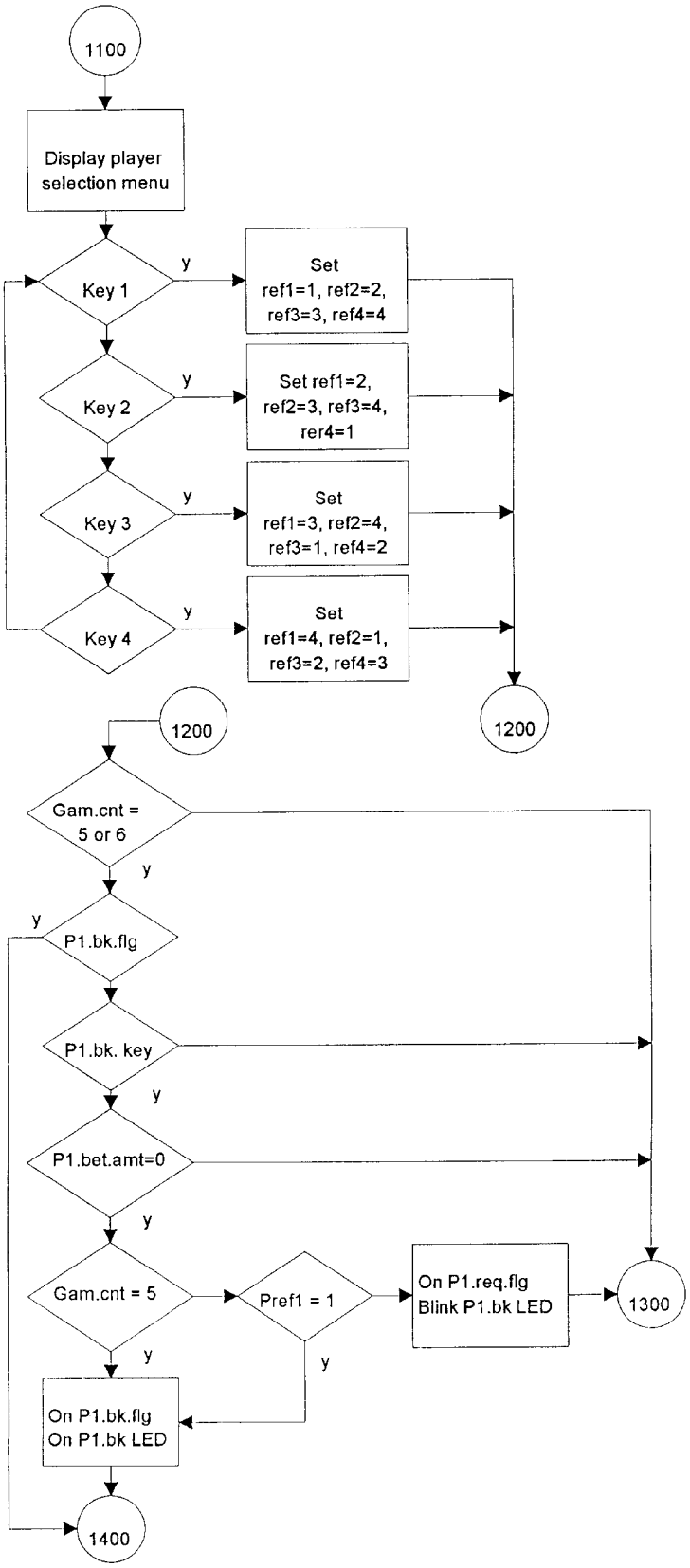
Figure 6:
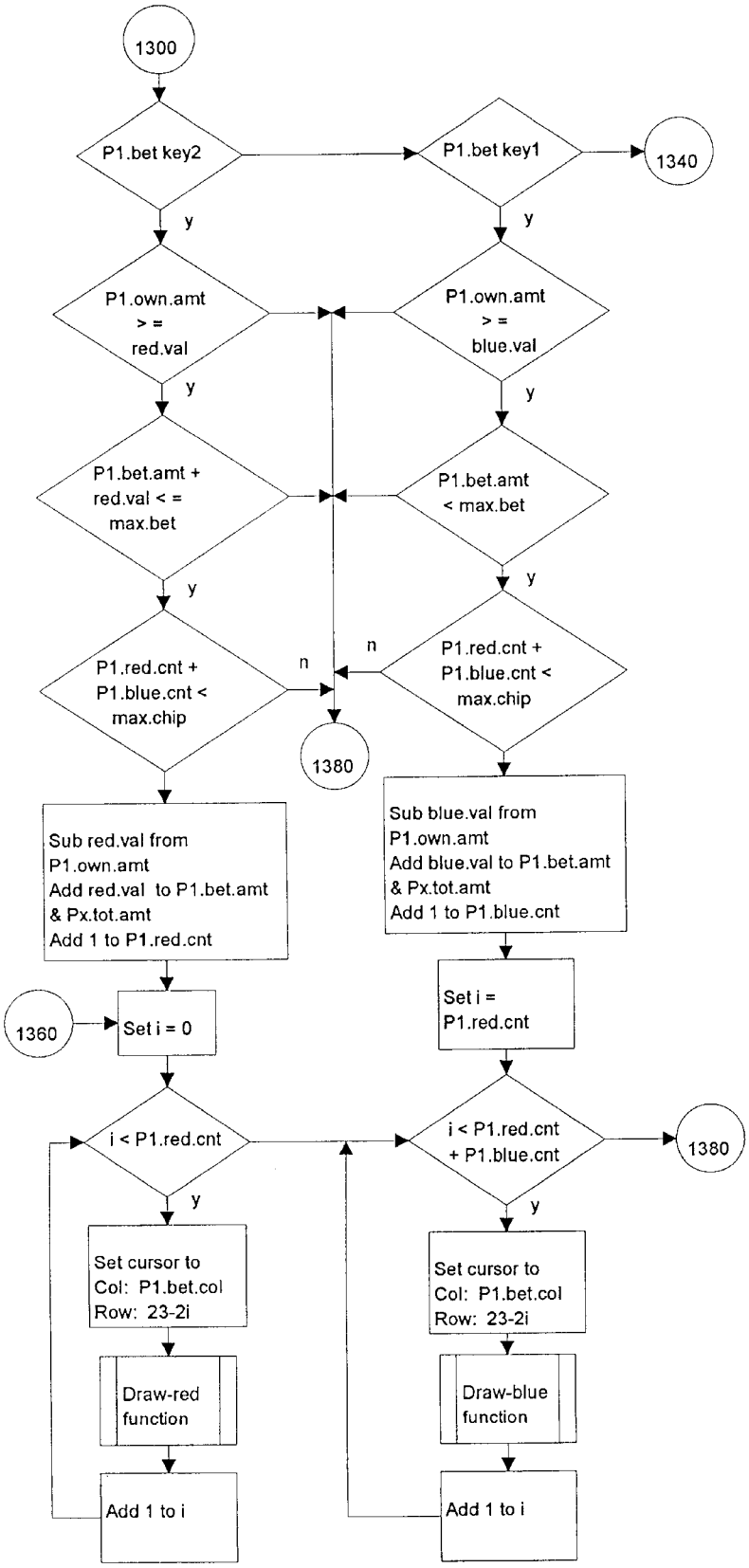
Figure 7:
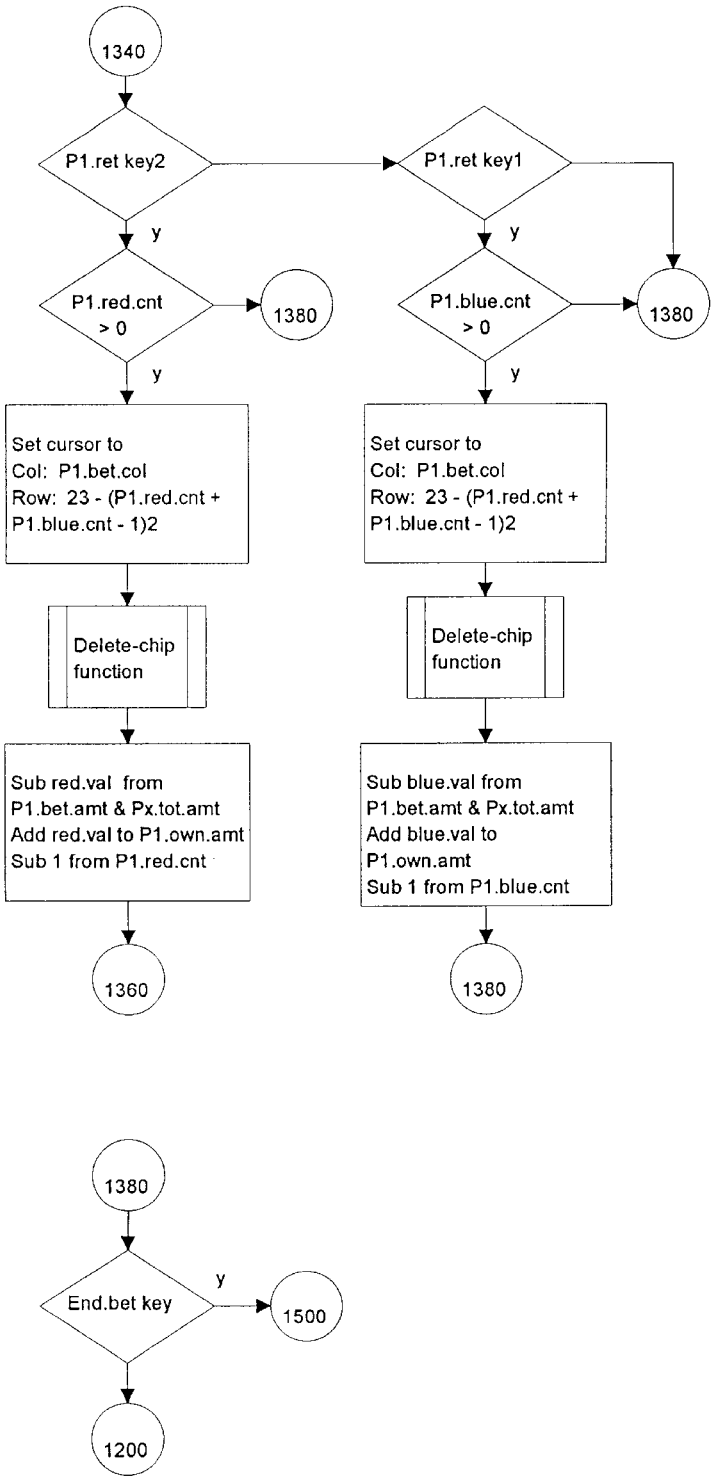
Figure 8:
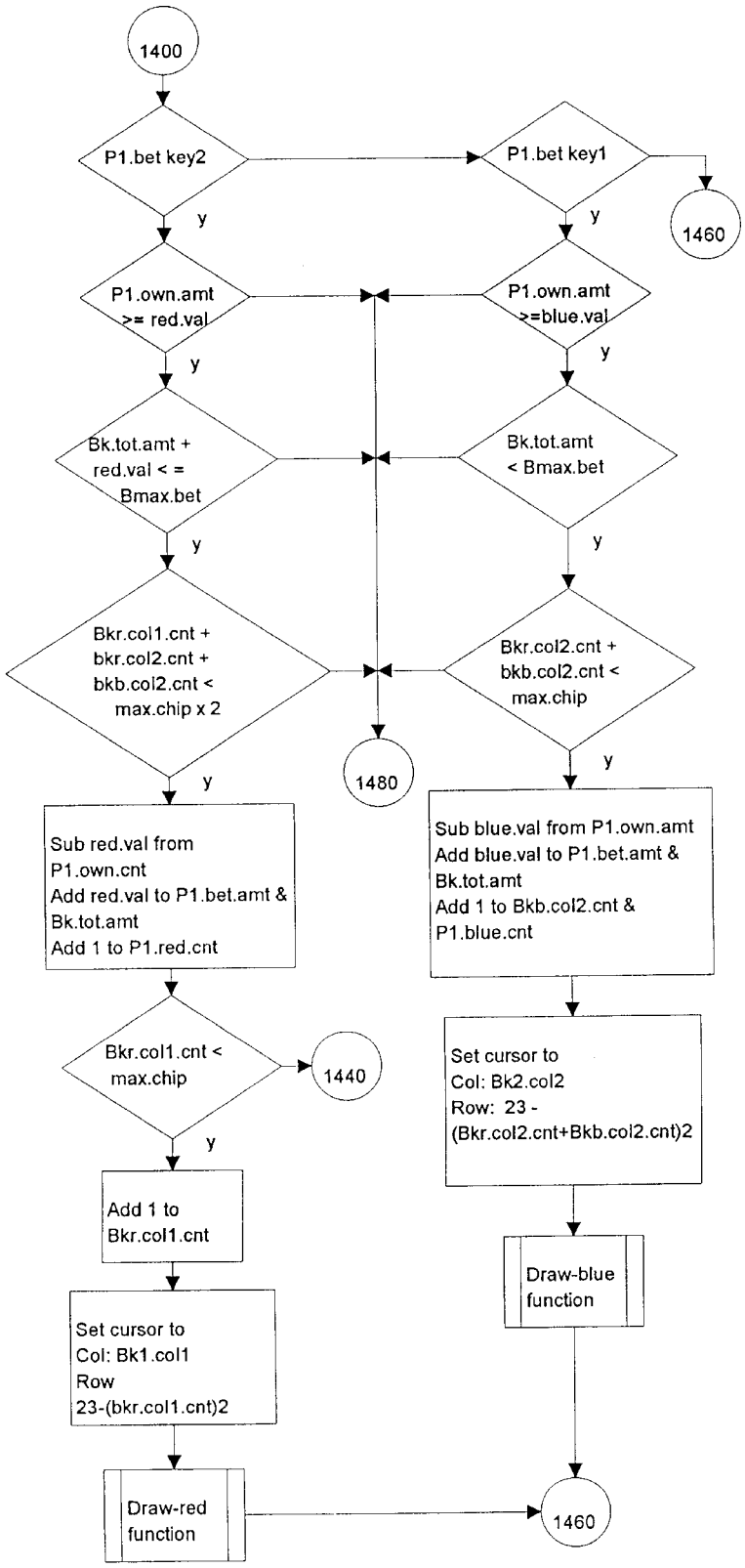
Figure 9:
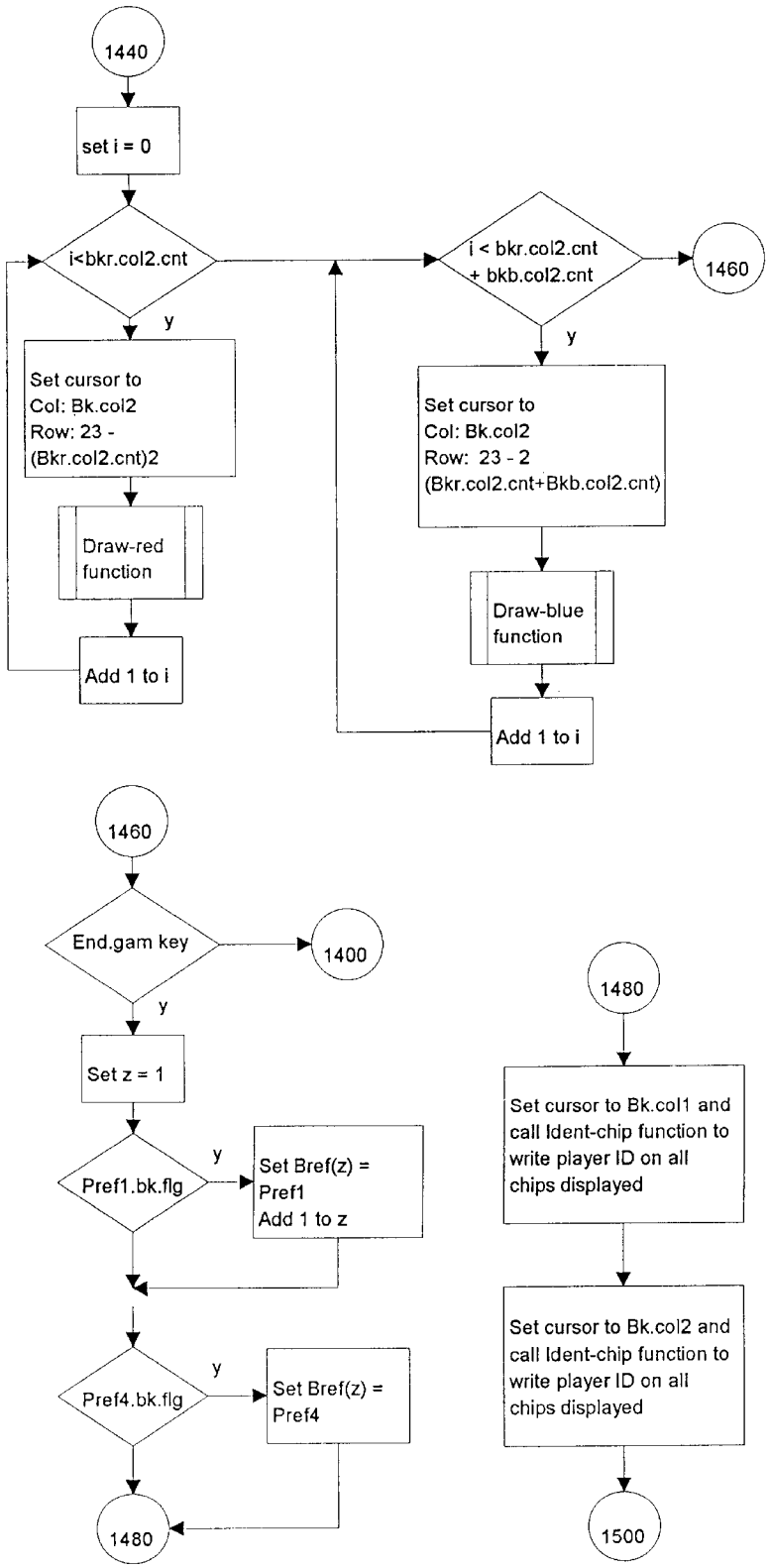
Figure 10:
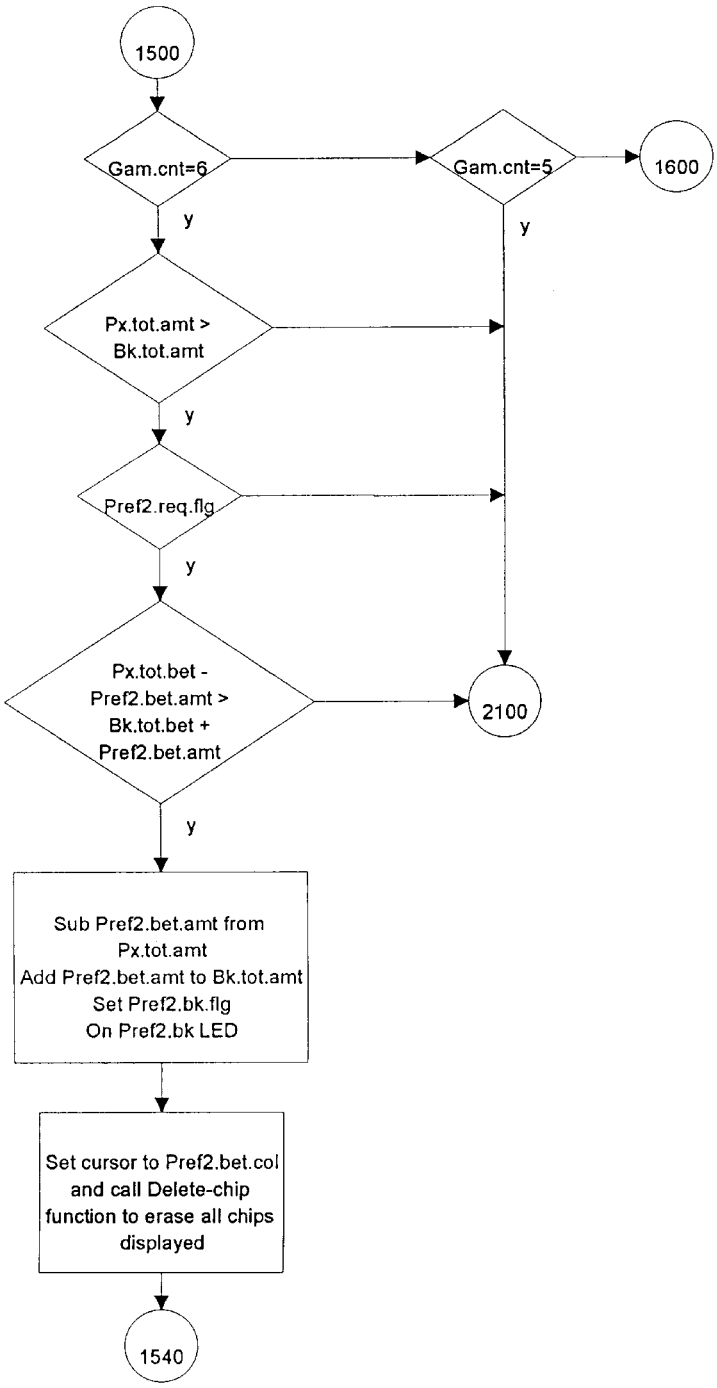
Figure 11:
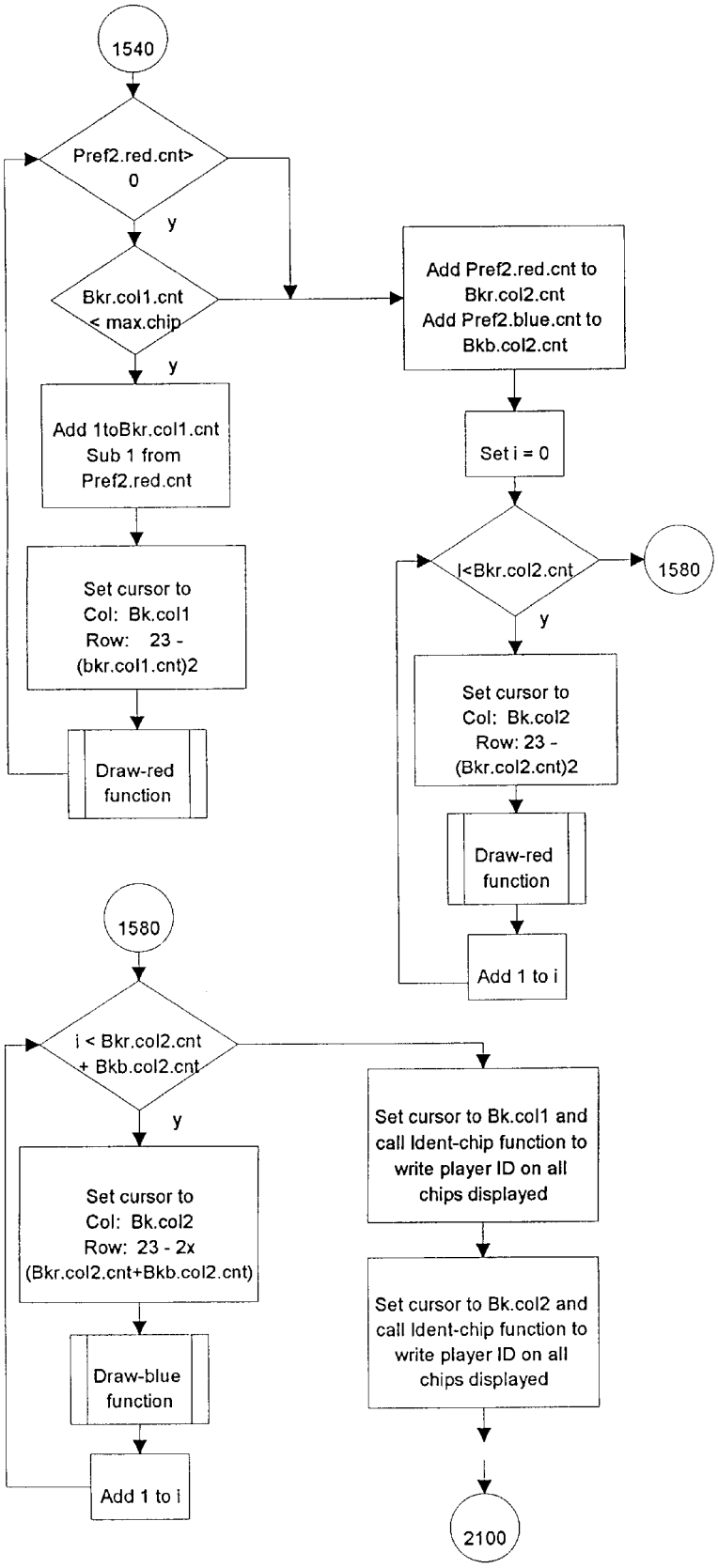
Figure 12:
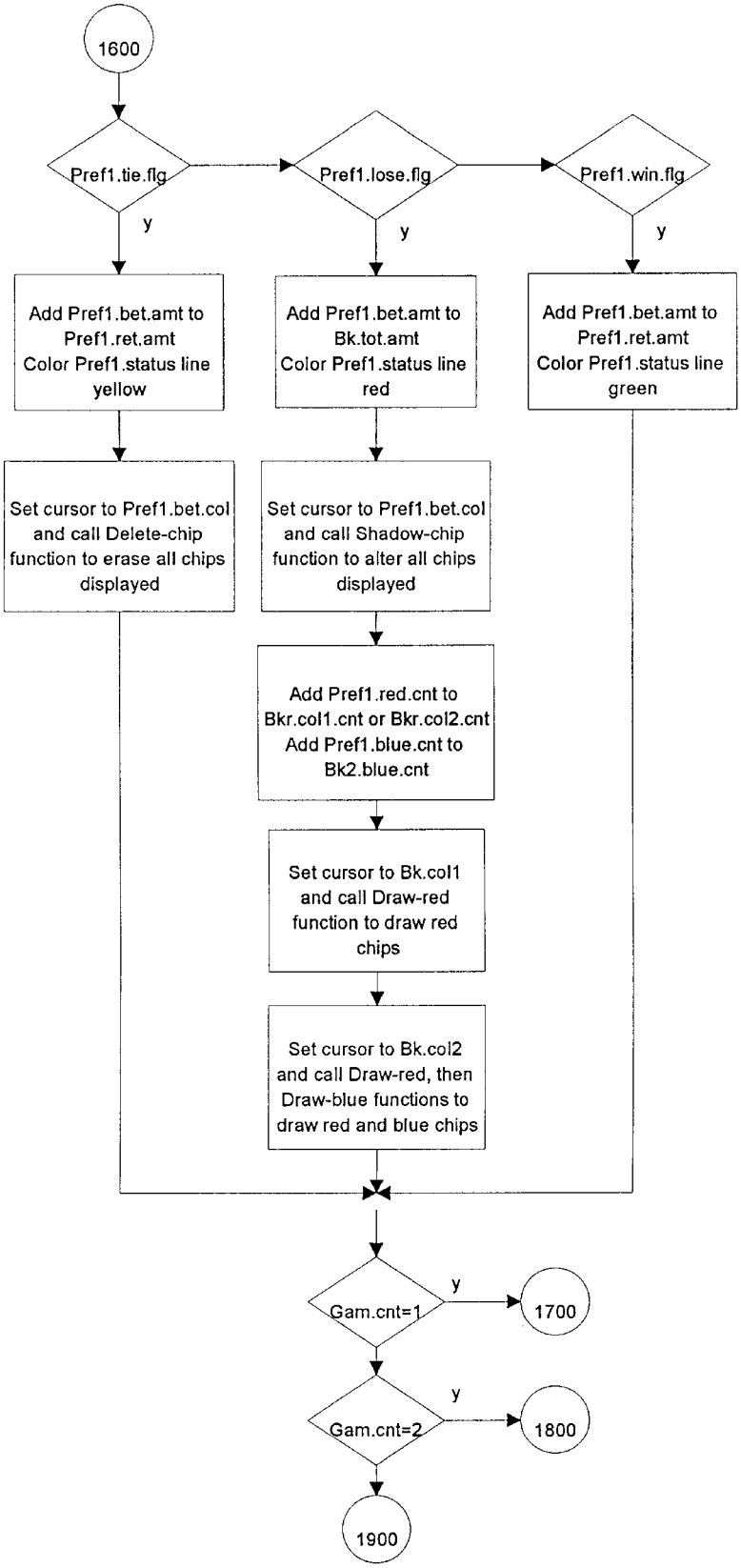
Figure 13:
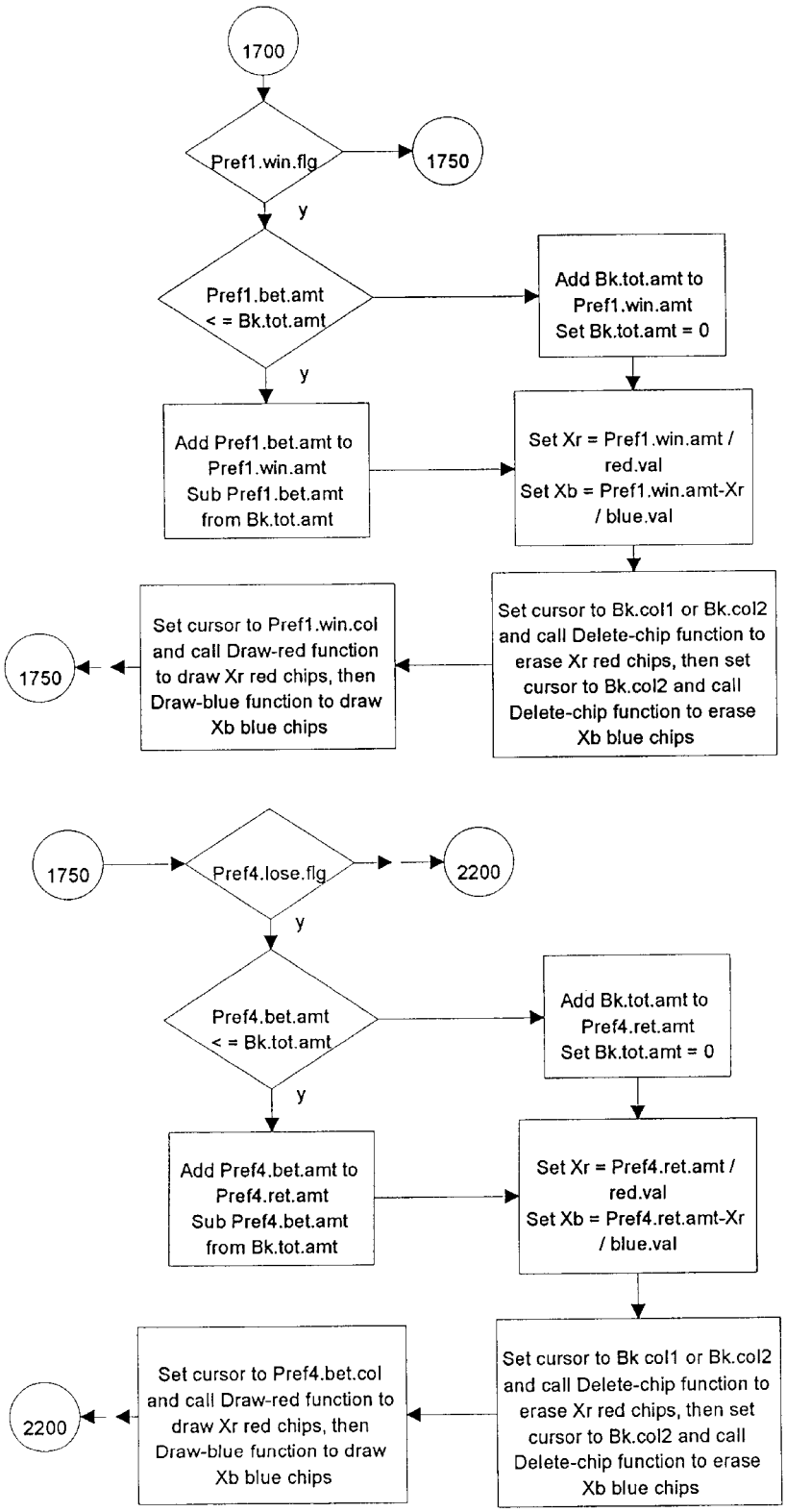
Figure 14:
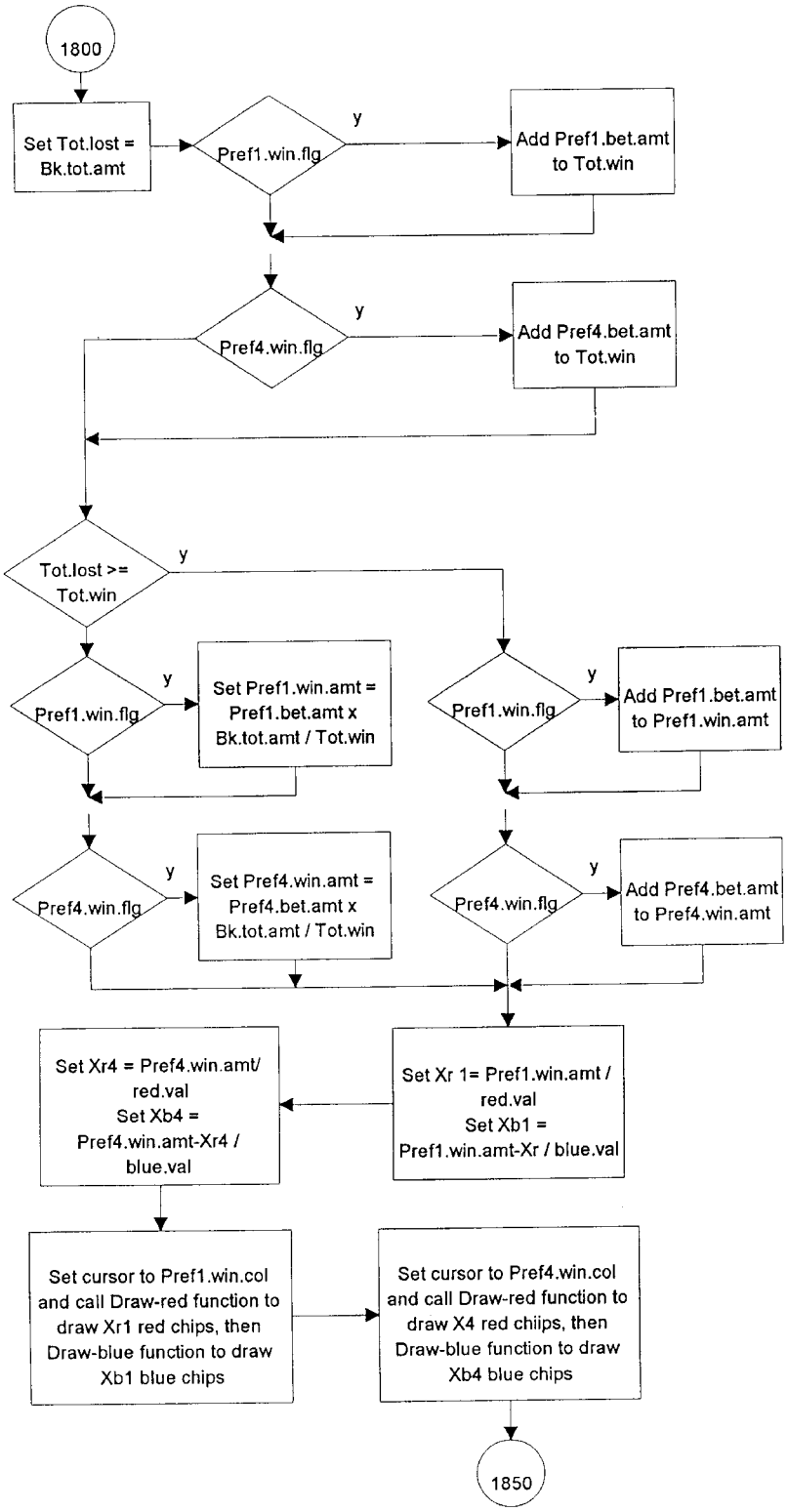
Figure 15:
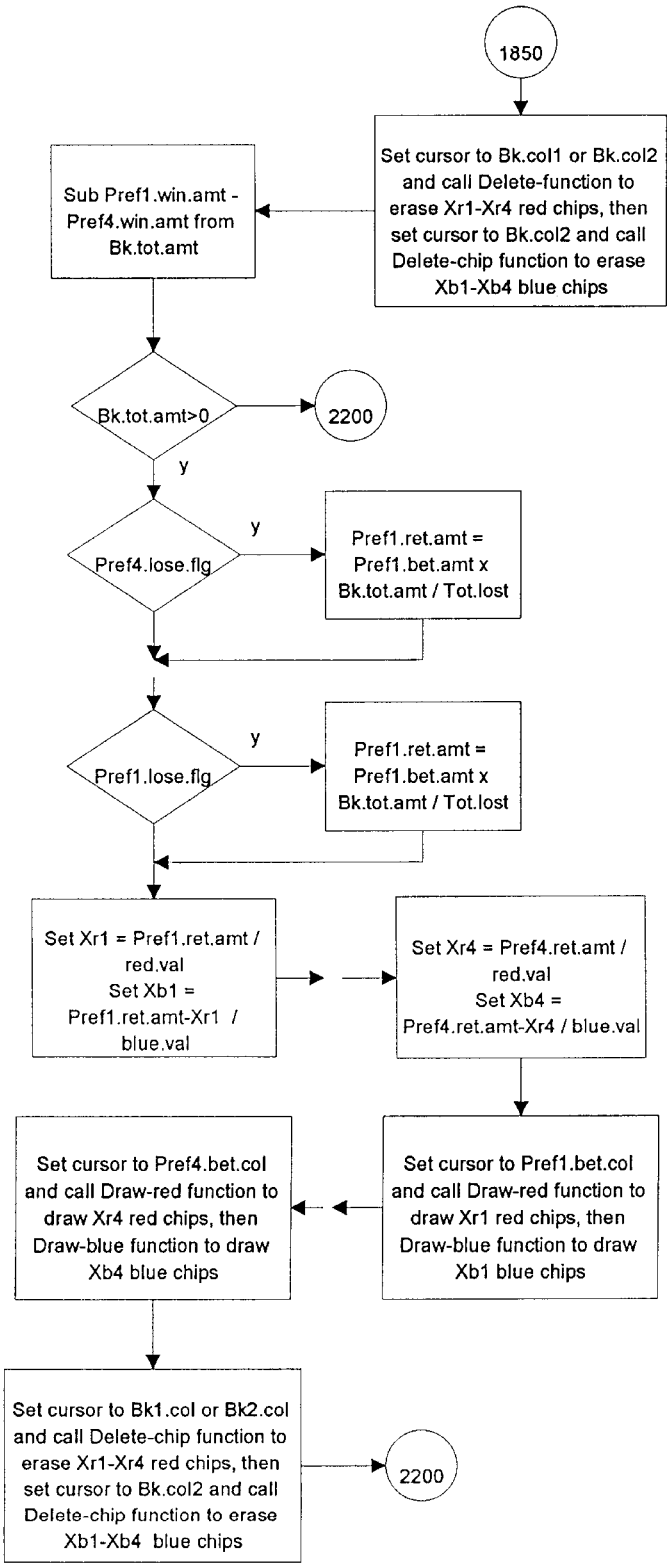
Figure 16:
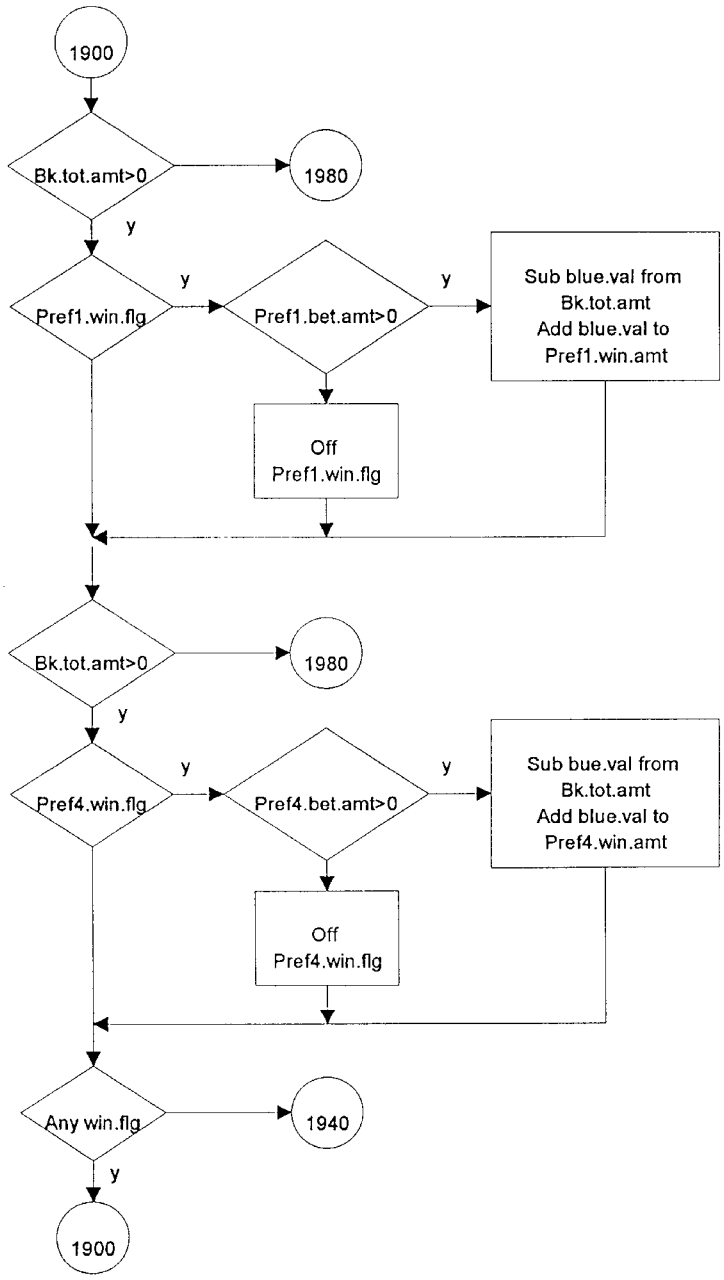
Figure 17:
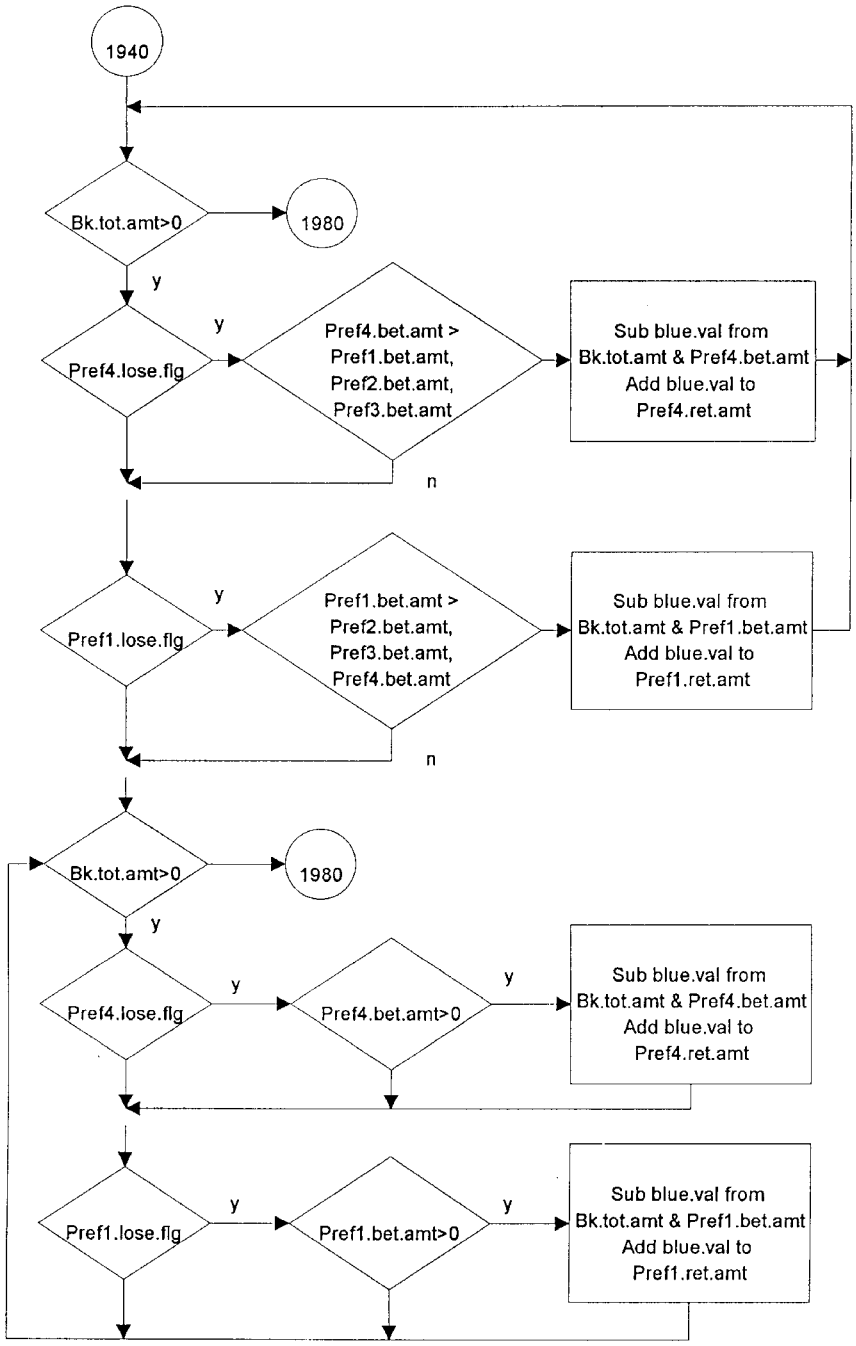
Figure 18:
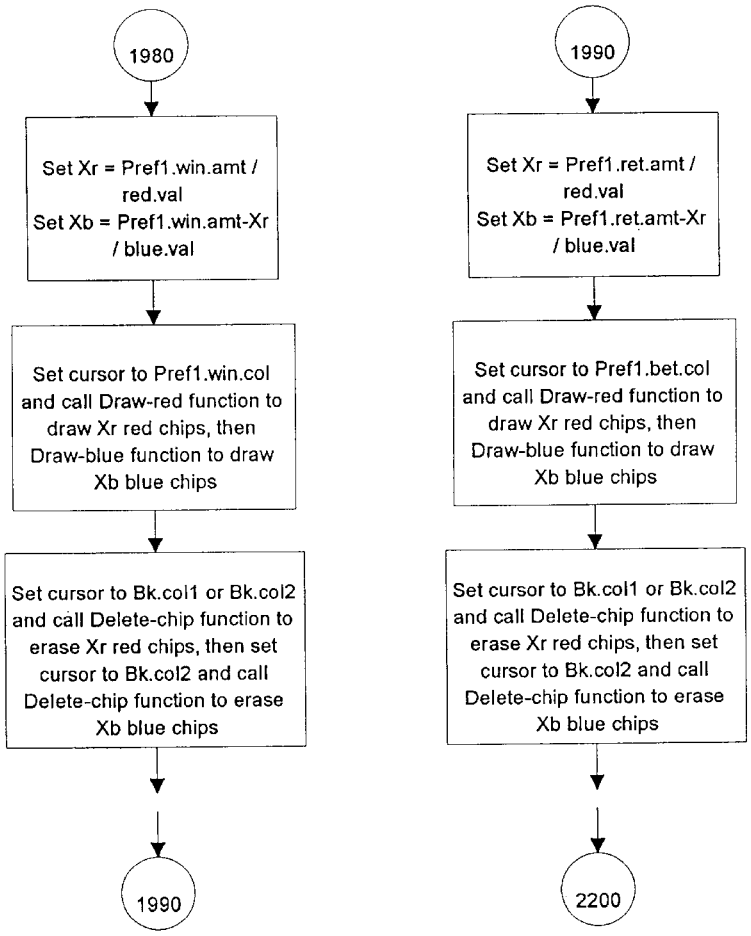
Figure 19:
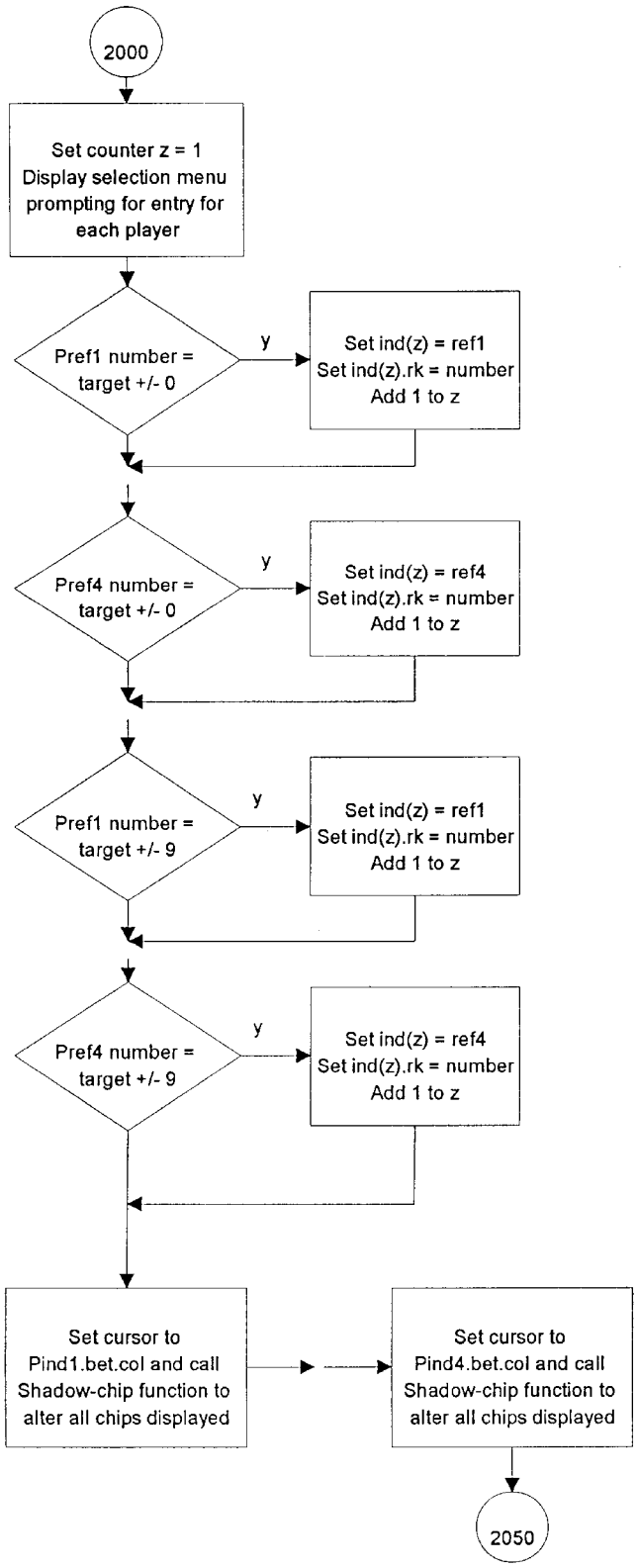
Figure 20:
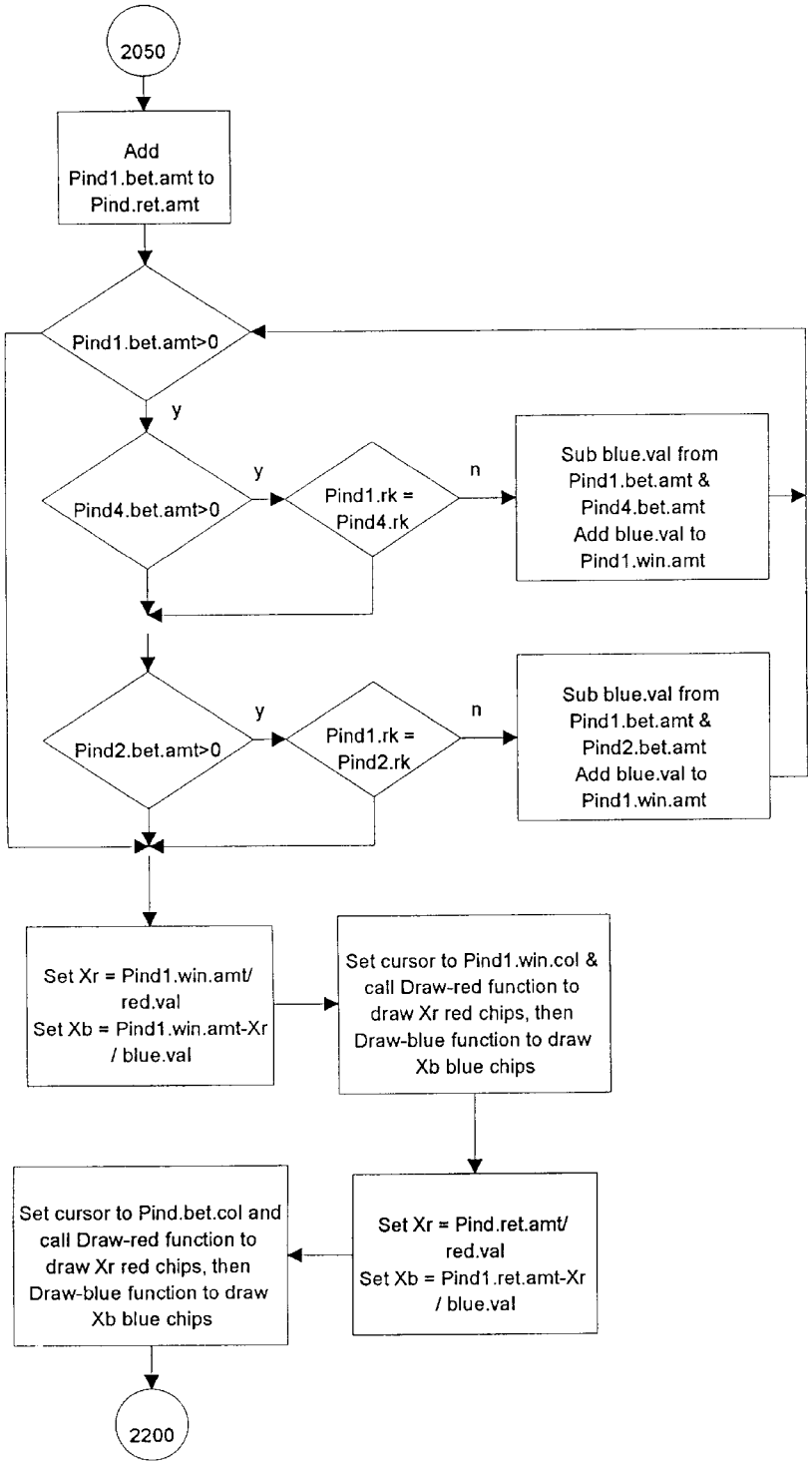
Figure 21:
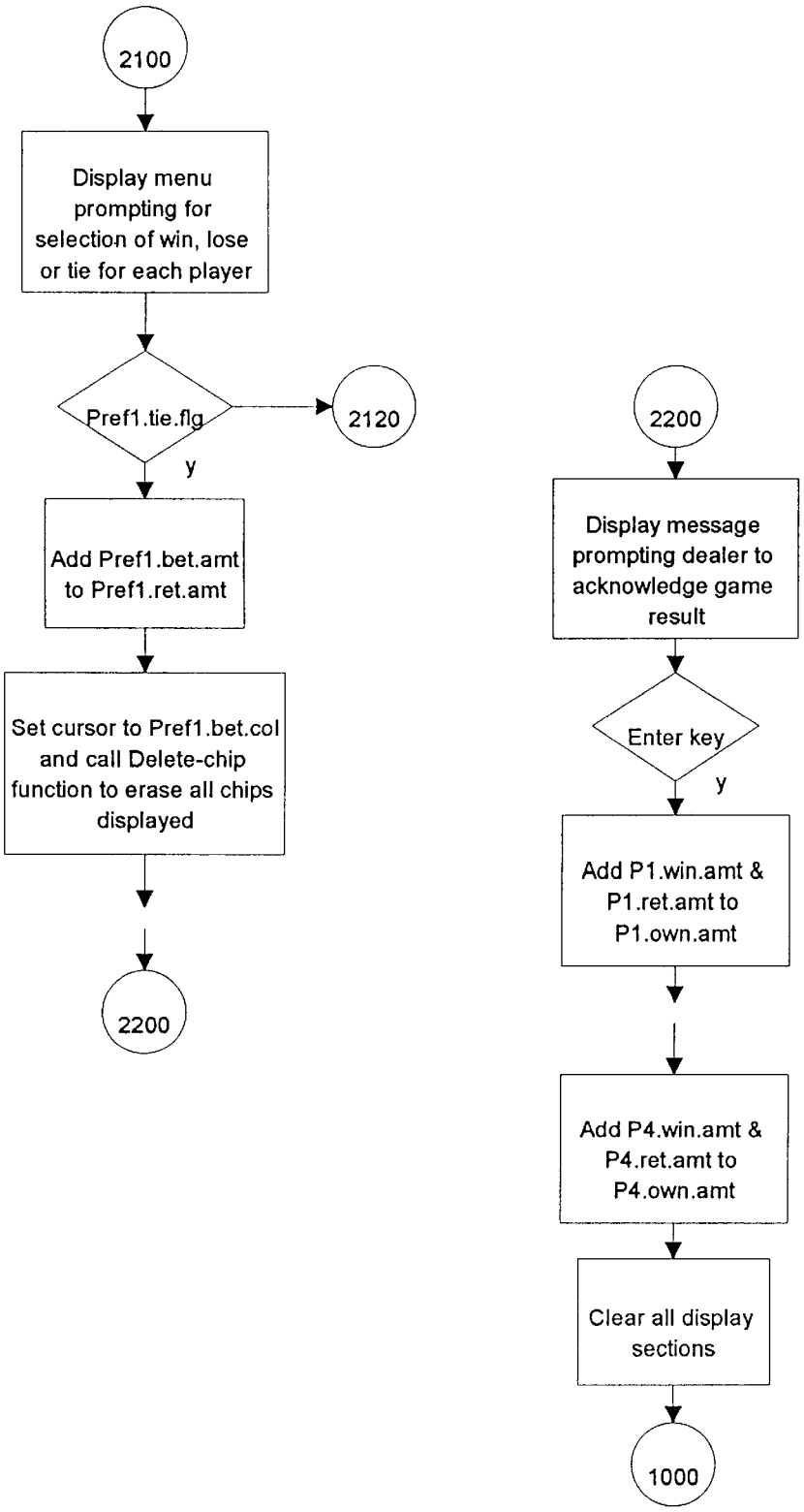
Figure 22:
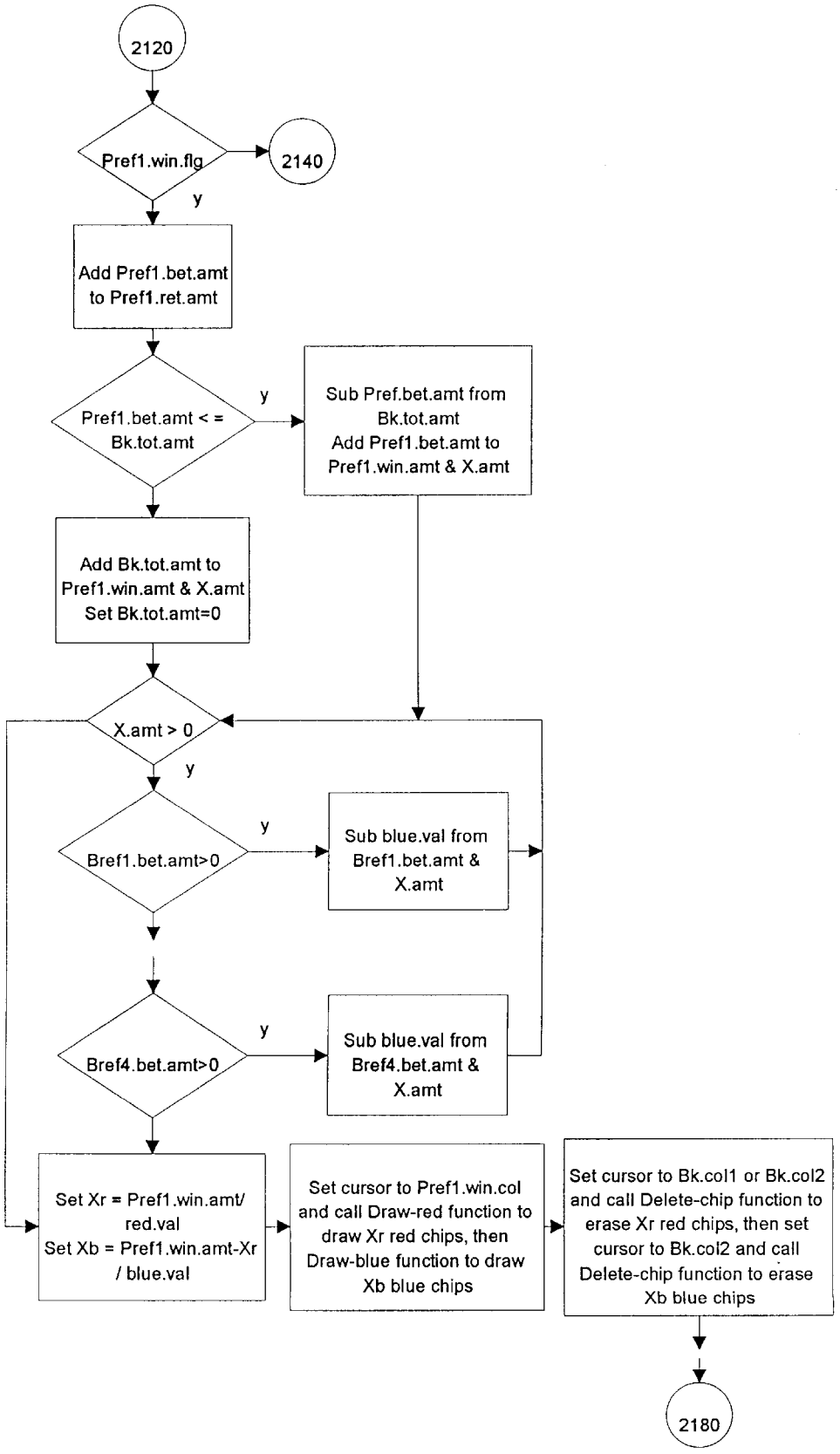
Figure 23:
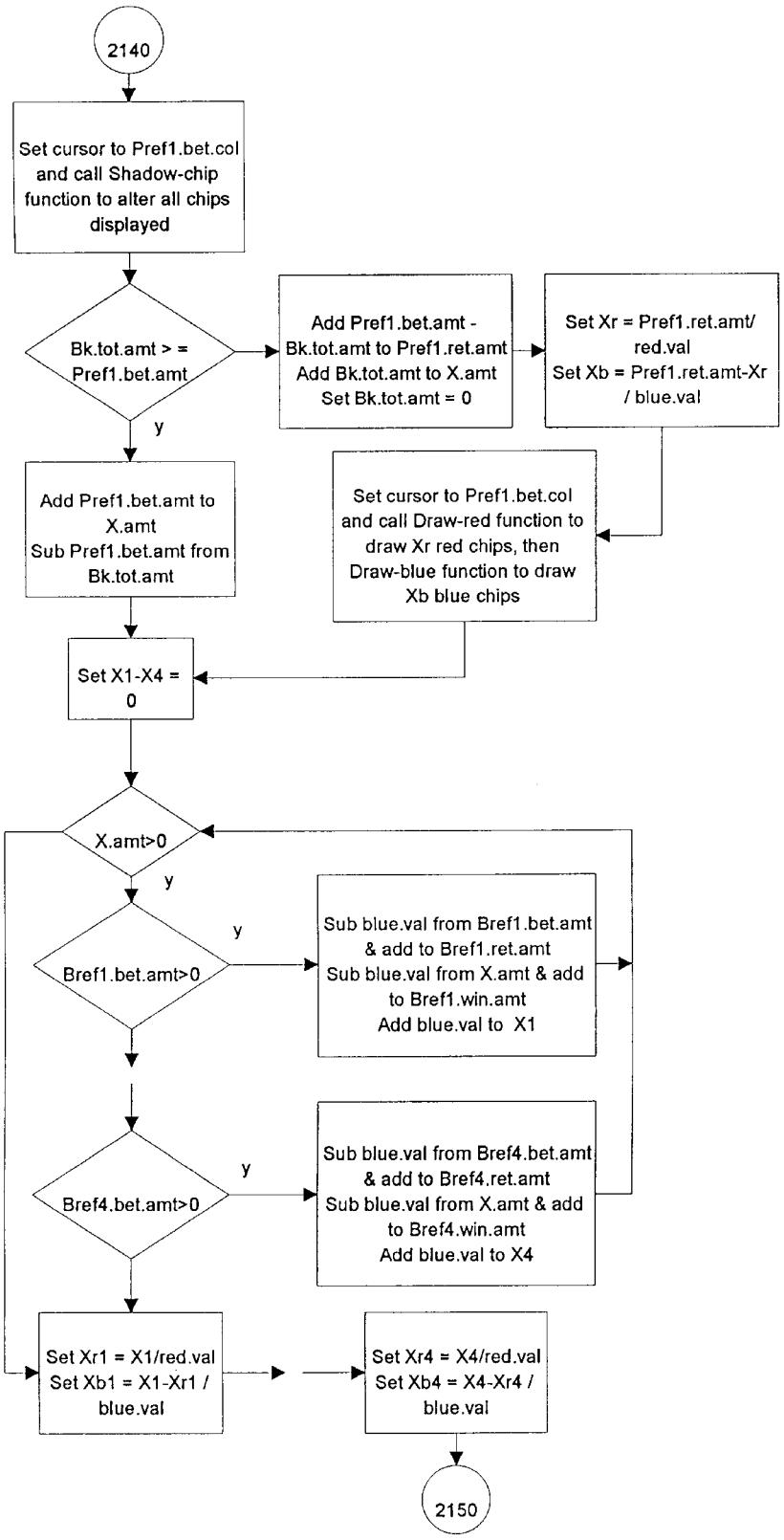
Figure 24:
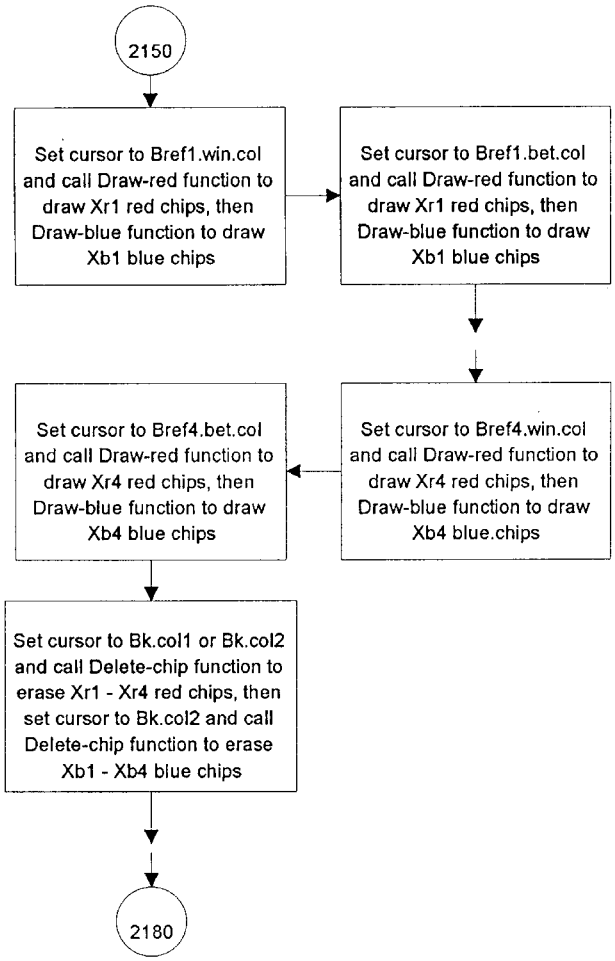
Figure 25:
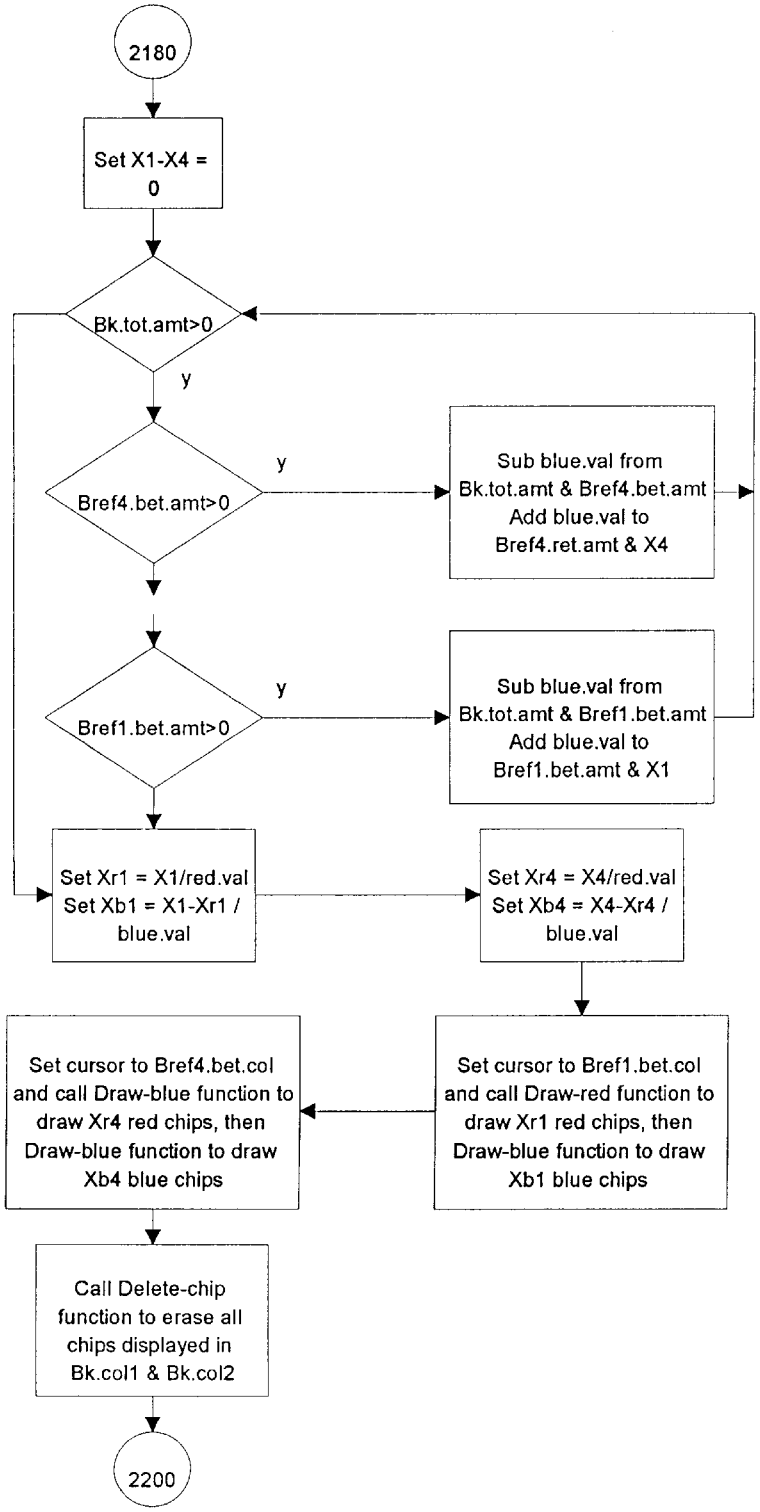

FIG. 3 illustrates the connection of all the components of the system to the I/O card of FIG. 2. The numeric display modules associated with the first, second, third and fourth players that indicate the number of chips or the amount of money belonging to said players are preferably self-contained, high resolution, bi-directional counters with built-in LCD display. This well-known type of module can be treated just like any IC.

Inputs I1, I2, I3 and I4 are connected to the BET.KEY1 associated with the first, second, third and fourth players respectively, inputs I5, I6, I7 and I8 are connected to the BET.KEY2 associated with said first, second, third and fourth players respectively, inputs I9, I10, I11 and I12 are connected to the RET.KEY1 associated with said first, second, third and fourth players respectively, inputs 113, 114, 115 and 116 are connected to the RET.KEY2 associated with said first, second, third and fourth players respectively, and inputs 117, 118, 119 and 120 are connected to the BK.KEY associated with said first, second, third and fourth players respectively.

Outputs T1, T2, T3 and T4 control the UP count of the display modules associated with said first, second, third and fourth players respectively, outputs T5, T6, T7 and T8 control the DOWN count of said display modules, and outputs T9, T10, T11 and T12 control the operation of the BK.LED's associated with said first, second, third and fourth players respectively.

Flow-chart 1000–2200 illustrates the logic of the computer program that operates the system. It is functionally divided into several sections. In the explanation that follows:

Variables GAM.CNT, BLUE.VAL, RED.VAL, MAX.BET, BMAX.BET and MAX.CHIPcontain gaming attributes relevant to the game being played.

GAM.CNT=1 indicates that the condition of the game is "bet against players and pay by position", in which case, all players compete against a common dealer for win/lose status while wagering against each other, with the amount wagered by the losing players going into a bank from which the winning players are paid. Winners are paid depending on their position at the table. Starting from a designated first player in rotation, each winner is paid in full, to the extend that the amount in the bank permits.

GAM.CNT=2 indicates that the game condition is "bet against players and pay by percentage", in which case, all players compete against a common dealer for win/lose status while wagering against each other, with the amount wagered by the losing players going into a bank from which the winning players are paid. Winners are paid regardless of their position at the table, with each receiving an amount that is proportional to the amount of his wager and inversely proportional to the amount wagered by the other winners.

GAM.CNT=3 indicates that the game condition is "bet against players and pay by increment", in which case, all players compete against a common dealer for win/lose status while wagering against each other, with the amount wagered by the losing players going into a bank from which the winning players are paid. Winners are paid regardless of their position at the table. Each selected winner is paid by equal incremental amounts, first to the limit of the lowest amount won by any selected winner, then to the limit of the next lower amounts won by the other selected winners, in descending order, to the extend that the amount in the bank is distributed.

GAM.CNT=4 indicates that the game condition is "bet against players and pay by ranking position", in which case, all players wager and compete against each other for position, with the highest ranked players automatically getting paid, in descending order, from the amount wagered by the lowest ranked players, in ascending order.

GAM.CNT=5 indicates that the game condition is "bet against elected bankers and pay by position", in which case, players compete and wager against a bank representing one or more elected bankers. Starting from a designated first player in rotation, each winner is paid in full from the bank, to the extend that the amount in the bank permits, and each loser loses the full amount wagered, to the extent that the amount is matched by the amount in the bank.

GAM.CNT=6 indicates that the game condition is "bet against conditional bankers and pay by position", in which case, players compete and wager against a bank representing a selected banker, with the provision to automatically adjust the amount in said bank to the level of the amount wagered against it by automatically transferring the amount or part of the amount wagered by one or more players into said bank and making said player or players associates in said bank, when said player or players have selected the option of being conditional bankers.

Graphic columns P1.BET.COL, P2.BET.COL, P3.BET.COL and P4.BET.COL are the areas within the common video monitor that are allocated for the display of graphic likeness of chips wagered by the first, second, third and fourth players respectively, graphic columns P1.WIN.COL, P2.WIN.COL, P3.WIN.COL and P4.WIN.COL are the areas within the common video monitor that are allocated for the display of graphic likeness of chips won by said first, second, third and fourth players respectively. Graphic columns BK.COL1 and BK.COL2 are the areas within the common video monitor that are allocated for the display of graphic likeness of chips wagered or temporarily stored in the bank.

Graphic rows P1.STATUS, P2.STATUS, P3.STATUS and P4.STATUS are areas within the common monitor that are allocated for the display of a symbol indicating a win, lose or tie selection for said first, second, third and fourth players respectively.

BLUE.VAL contains the monetary value assigned to the lower denomination chips whose color may be blue, RED-.VAL contains the monetary value assigned to chips of a higher denomination whose color may be red, MAX.BET contains the maximum amount that may be wagered by any player, BMAX.BET contains the maximum amount that may be wagered in the bank, and MAX.CHIP indicate the maximum number of chips that can be displayed in any display column.

Counters P1.OWN.AMT, P2.OWN.AMT, P3.OWN.AMT and P4.OWN.AMT store the amount belonging to the first, second, third and fourth players respectively, counters P1.BET.AMT, P2.BET.AMT, P3.BET.AMT and P4.BET.AMT store the amount wagered by said first, second, third and fourth players respectively, counters P1.WIN.AMT, P2.WIN.AMT, P3.WIN.AMT and P4.WIN.AMT store the amount won in a game by said first, second, third and fourth players respectively, and counters P1.RET.AMT, P2.RET.AMT, P3.RET.AMT and P4.RET.AMT store the amount refunded at the end of a game to said first, second, third and fourth players respectively.

Counters P1.BLUE.CNT, P2.BLUE.CNT, P3.BLUE.CNT and P4.BLUE.CNT store the number of blue chips displayed in columns P1.BET.COL, P2.BET.COL, P3.BET.COL and P4.BET.COL respectively, counters P1.RED.CNT, P2.RED.CNT, P3.RED.CNT and P4.RED.CNT store the number of red chips displayed in columns P1.BET.COL, P2.BET.COL, P3.BET.COL and P4.BET.COL respectively. Counter BKR.COL1 stores the number of red chips displayed in column BK.COL1, counter BKR.COL2 stores the number of red chips displayed in column BK.COL2, and counter BKB.COL2 stores the number of blue chips displayed in column BK.COL2. Counter BK.TOT.AMT stores the amount wagered or stored in the bank, and counter PX.TOT.AMT stores the total amount wagered by all players outside of said bank.

Flags P1.WIN.FLG, P2.WIN.FLG, P3.WIN.FLG and P4.WIN.FLG indicate that a win selection has been made for said first, second, third and fourth players respectively, flags P1.LOSE.FLG, P2.LOSE.FLG, P3.LOSE.FLG and P4.LOSE.FLG indicate that a lose selection has been made for said first, second, third and fourth players respectively, and flags P1.TIE.FLG, P2.TIE.FLG, P3.TIE.FLG and P4.TIE.FLG indicate that a tie selection has been made for said first, second, third and fourth players respectively.

Flags P1.BK.FLG, P2.BK.FLG, P3.BK.FLG and P4.BK.FLG indicate that the first, second, third and fourth players have selected the option of betting in the bank respectively, and flags P1.REQ.FLG, P2.REQ.FLG, P3.REQ.FLG and P4.REQ.FLG indicate that the first, second, third and fourth players have selected the option of having their wager transferred in the bank under certain conditions respectively.

Each of the counters and flags specified has a mirror counter and flag which automatically assumes the value or status of said counter and flag during the course of a game. The value and status of those mirror counters and flags are retained until a new game is initiated.

Keys P1.BET.KEY1, P2.BET.KEY1, P3.BET.KEY1 and P4.BET.KEY1 allow said first, second, third and fourth players to bet a blue chip respectively, keys P1.BET.KEY2, P2.BET.KEY2, P3.BET.KEY2 and P4.BET.KEY2 allow said first, second, third and fourth players to bet a red chip respectively, keys P1.RET.KEY1, P2.RET.KEY1, P3.RET.KEY1 and P4.RET.KEY1 allow said first, second, third and fourth players to withdraw a blue chip from their bet respectively, keys P1.RET.KEY2, P2.RET.KEY2, P3.RET.KEY2 and P4.RET.KEY2 allow said first, second, third and fourth players to withdraw a red chip from their bet respectively, keys P1.BK.KEY, P2.BK.KEY, P3.BK.KEY and P4.BK.KEY allow said first, second, third and fourth players to select the option of betting in the bank in certain games, and LED's P1.BK.LED, P2.BK.LED, P3.BK.LED and P4.BK.LED indicate that said first, second, third and fourth players have selected the option of betting in the bank, in certain games.

A number of additional keys may be associated with said players that allow each of said players to select the display section on which the chips wagered are displayed. For instance, player one may select to display the chips wagered on the display section normally associated with player four.

A number of subroutines are called during program execution to perform certain functions. DRAW-RED draws a red chip at the location specified, DRAW-BLUE draws a blue chip at the location specified, DELETE-CHIP deletes the chip at the location specified, SHADOW-CHIP alters the chip at the location specified, and IDENT-CHIP writes a number or symbol identifying a specific player on every chip displayed on the display column specified.

Flow-chart section 1000 illustrates the process by which a dealer selects a game to play from a game selection menu, sell chips to players, buys chips from players, recalls a game played, and initiates a new game. The main selection menu is displayed, prompting the dealer to make a selection. When a new game is selected, the gaming parameters are copied into game variables GAM.CNT, RED.VAL, BLUE.VAL, MAX.BET, BMAX.BET and MAX.CHIP. Operation goes to section 1100 when the start game option is selected.

Flow-chart section 1100 illustrates the process of selecting a designated first player from whose position the game starts. A menu is displayed, prompting the dealer to enter on keyboard 192, the number corresponding to a designated player, based on some gaming condition such as the throw of a dice. Pointer ref1 is set to the number identifying the selected player, and pointers ref2, ref3, ref4 are set to numbers identifying the following players in sequence. Operation goes to section 1200.

Flow-chart section 1200 illustrates the first part of the betting process involving player one.

If GAM.CNT is set to 5, P1.BK.FLG is set and P1.BK.LED is turned on, when key P1.BK.KEY is pressed, providing that said player has not placed a bet, P1.BET.AMT=0. Operation goes to section 1400.

If GAM.CNT is set to 6, P1.BK.FLG is set and P1.BK.LED is turned on, when key P1.BK.KEY is pressed if player one is the designated first player, Pref1=1, providing that said player has not placed a bet, P1.BET.AMT=0. Operation goes to section 1400.

If GAM.CNT is set to 6, P1.REQ.FLG is set and P1.BK.LED flashes on momentarily, when key P1.BK.KEY is pressed, if player one is not the designated first player.

If GAM.CNT is set to 1, 2, 3 or 4, indicating that there are no bankers in the game, or GAM.CNT is set to 5 or 6 and flag P1.BK.FLG is not set, operation goes to section 1300.

Flow-chart section 1300 illustrates the betting process involving player one when there is no banker in the game or said player is not a banker.

Each time key P1.BET.KEY1 is pressed, the value of a blue chip BLUE.VAL is transferred from the amount owned by said player in P1.OWN.AMT to the amount wagered by said player in P1.BET.AMT, until the maximum betting limit MAX.BET is reached or the maximum allowable number of chips MAX.CHIP are displayed. BLUE.VAL is also added to the total amount wagered by all players in PX.TOT.AMT. Subroutine DRAW-BLUE is called to draw a blue chip on column P1.BET.COL at the first chip location that is vacant, starting from row 23. Counters P1.RED.CNT and P1.BLUE.CNT indicate the number of red and blue chips wagered by said player.

Each time key P1.BET.KEY2 is pressed, the value of a red chip RED.VAL is transferred from the amount owned by said player in P1.OWN.AMT to the amount wagered by said player in P1.BET.AMT, until the maximum betting limit MAX.BET is reached or the maximum allowable number of chips MAX.CHIP are displayed. RED.VAL is also added to the total amount wagered by all players in PX.TOT.AMT. The chips displayed on column P1.BET.COL are redrawn to place all the red chips on the first chip locations, starting from location one at row 23, and the blue chips on the following chip locations, by calling subroutines DRAW-RED and DRAW-BLUE.

Each time key P1.RET.KEY1 is pressed, the value of a blue chip BLUE.VAL is transferred from the amount wagered by said player in P1.BET.AMT to the amount owned by said player in P1.OWN.AMT, until all blue chips wagered are withdrawn. BLUE.VAL is also deducted from the total amount wagered by all players in PX.TOT.AMT. Subroutine DELETE-CHIP is called to erase the last chip displayed on column P1.BET.COL. Counters P1.RED.CNT and P1.BLUE.CNT point to the last chip displayed on column P1.BET.COL.

Each time key P1.RET.KEY2 is pressed, the value of a red chip RED.VAL is transferred from the amount wagered by said player in P1.BET.AMT to the amount owned by said player in P1.OWN.AMT, until all red chips wagered are withdrawn. RED.VAL is also deducted from the total amount wagered by all players in PX.TOT.AMT. Subroutine DELETE-CHIP is called to erase the last chip displayed on column P1.BET.COL. The chips displayed on column P1.BET.COL are then redrawn to place all the red chips on the first chip locations, starting from location one at row 23, and the blue chips on the following chip locations, by calling subroutines DRAW-RED and DRAW-BLUE.

The process is repeated until the END.BET key is pressed to end the betting process. Operation then goes to section 1500.

Flow-chart section 1400 illustrates the betting process involving player one if GAM.CNT is set to 5 or 6 and the option of betting in the bank is selected, P1.BK.FLG on.

Each time key P1.BET.KEY1 is pressed, the value of a blue chip BLUE.VAL is transferred from the amount owned by said player in P1.OWN.AMT to the amount wagered by said player in P1.BET.AMT. BLUE.VAL is also added to the amount wagered in the bank in BK.TOT.AMT. Subroutine DRAW-BLUE is called to draw a blue chip on column BK.COL2 at the first chip location that is vacant. Counters BKR.COL2.CNT and BKB.COL2.CNT indicate the number of red and blue chips displayed on column BK.COL2, while counter B1.BLUE.CNT indicates the number of blue chips wagered in the bank by said player.

Each time key P1.BET.KEY2 is pressed, the value of a red chip RED.VAL is transferred from the amount owned by said player in P1.OWN.AMT to the amount wagered by said player in P1.BET.AMT. RED.VAL is also added to the amount wagered in the bank in BK.TOT.AMT. Subroutine DRAW-RED is called to draw a red chip on column BK.COL1 at the first chip location that is vacant. If all the chip locations in column BK.COL1 are already used, the chip is drawn on column BK.COL2. The chips displayed on column BK.COL2 are redrawn to place all the red chips on the first chip locations, starting from location one at row 23, and the blue chips on the following chip locations, by calling subroutines DRAW-RED and DRAW-BLUE. Counters BKR.COL2.CNT and BKB.COL2.CNT indicate the number of red and blue chips displayed on column BK.COL2.

This process is repeated until the END.BET key is pressed to end the betting process.

The betting process involving players two, three and four is similar, with P2.OWN.AMT, P2.BET.AMT, P2.BET.KEY1, P2.BET.KEY2, P2.RET.KEY1, P2.RET.KEY2, P2.BK.KEY, P2.BK.FLG, P2.REQ.FLG, P2.RED.CNT, P2.BLUE.CNT, P2.BET.COL; P3.OWN.AMT, P3.BET.AMT, P3.BET.KEY1, P3.BET.KEY2, P3.RET.KEY1, P3.RET.KEY2, P3.BK.KEY, P3.BK.FLG, P3.REQ.FLG, P3.RED.CNT, P3.BLUE.CNT, P3.BET.COL; P4.OWN.AMT, P4.BET.AMT, P4.BET.KEY1, P4.BET.KEY2, P4.RET.KEY1, P4.RET.KEY2, P4.BK.KEY, P4.BK.FLG, P4.REQ.FLG, P4.RED.CNT, P4.BLUE.CNT, P4.BET.COL, performing for players two, three and four respectively, the same functions that P1.OWN.AMT, P1.BET.AMT, P1.BET.KEY1, P1.BET.KEY2, P1.RET.KEY1, P1.RET.KEY2, P1.BK.KEY, P1.BK.FLG, P1.REQ.FLG, P1.RED.CNT, P1.BLUE.CNT, P1.BET.COL perform for player one.

A priority sequence is then established for the bankers. Starting from the first designated player, the first player who bet in the bank is registered as the first designated banker Bref1, and the next players who bet in the bank are registered as the second, third and fourth bankers Bref2, Bref3 and Bref4 respectively. Subroutine IDENT-CHIP is called to assign to the chips displayed on columns BK.COL1 and BK.COL2, a symbol or number identifying the players they belong to, starting from the designated first banker. Starting from the first chip position in column BK.COL1 to the last chip position in that column and continuing on the first chip position in column BK.COL2: the symbol or number identifying the first designated banker is written into every red chip wagered by said player, as denoted by the content of counter Bref1.RED.CNT, then the symbol or number identifying the second, third and fourth bankers is written into every red chips wagered by said second, third and fourth players as denoted by the content of counters Bref2.RED.CNT, Bref3.RED.CNT and Bref4.RED.CNT respectively. Then starting from the position of the first blue chip displayed in column BK.COL2, the symbol or number identifying the first designated banker Bref1 is written into every blue chip wagered by said player, as denoted by the content of counter Bref1.BLUE.CNT, then the symbol or number identifying the second, third and fourth bankers is written into every blue chips wagered by said second, third and fourth bankers as denoted by the content of counters Bref2.BLUE.CNT, Bref3.BLUE.CNT and Bref4.BLUE.CNT respectively. Operation then goes to section 1500.

Flow-chart section 1500 illustrates the process that takes place after the betting process.

If GAM.CNT is set to 6, indicating that there may be conditional bankers, and the amount wagered against the bank is greater than the amount wagered in the bank, PX.TOT.AMT>BK.TOT.AMT: The designated second player Pref2 becomes an associate banker if said player is a conditional banker, Pref2.REQ.FLG set, and the amount wagered by said player against the bank in Pref2.BET.AMT can be transferred into said bank without making the amount in said bank greater than the amount wagered against it by the other players. In this instance, subroutine DELETE-CHIP is called to erase the chips displayed on column Pref2.BET.AMT, and subroutine DRAW-RED and DRAW-BLUE are called to draw on columns BK.COL1 and BK.COL2, a number of red and blue chips corresponding to the amount transferred into the bank.

The designated third and fourth players become associates bankers under similar conditions with Pref3.BET.AMT, Pref3.REQ.FLG, Pref3.BET.COL and Pref4.BET.AMT, Pref4.REQ.FLG, Pref4.BET.COL, performing for said third and fourth players the same functions that Pref1.BET.AMT, Pref1.REQ.FLG, Pref1.BET.COL perform for the designated first player.

The bankers priority sequence is then rearranged to include the new banker(s), in the same manner previously described, and subroutine IDENT-CHIP is called to assign to the chips displayed on columns BK.COL1 and BK.COL2 the number of symbol identifying the players they belong to. Operation then goes to section 2100.

Operation goes to section 1600 if GAM.CNT is set to 1, 2 or 3, to section 2000 if GAM.CNT is set to 4, or to section 2100 if GAM.CNT is set to 6.

Flow-chart section 1600 illustrates the chip collection process that takes place after the betting process if GAM-.CNT is set to 1, 2 or 3.

A menu is displayed, prompting the dealer to select for each player, a win, lose or tie condition, setting a WIN.FLG, LOSE.FLG or TIE.GLG for each said player. For the first designated player:

If a tie selection is made for said player, the amount wagered by said player in Pref1.BET.AMT is refunded in Pref1.RET.AMT, a yellow marking is displayed in Pref1.STATUS line and subroutine DELETE-CHIP is called to erase the chips displayed in Pref1.BET.COL.

If a lose selection is made for said player, the amount wagered by said player in Pref1.BET.AMT is added to the bank in BK.TOT.AMT, and a red marking is displayed in P1.STATUS line. Subroutine SHADOW-CHIP is called to alter the chips displayed in column Pref1.BET.COL to indicate that said chips are lost to the bank, and subroutines DRAW-RED and DRAW-BLUE are called to draw on columns BK.COL1 and BK.COL2, a number of red and blue chips corresponding to the amount added into the bank.

If a win selection is made for said player, the amount wagered by said player in Pref1.BET.AMT is refunded in Pref1.RET.AMT, and a green marking is displayed in Pref1.STATUS line.

The selection process for the second, third and fourth designated players is similar with Pref2.0WN.AMT, Pref2.BET.AMT, Pref2.RET.AMT, Pref2.BET.COL, Pref2.RED.CNT, Pref2.BLUE.CNT; Pref3.OWN.AMT, Pref3.BET.AMT, Pref3.RET.AMT, Pref3.BET.COL, Pref3.RED.CNT, Pref3.BLUE.CNT; Pref4.OWN.AMT, Pref4.BET.AMT, Pref4.RET.AMT, Pref4.BET.COL, Pref4.RED.CNT, Pref4.BLUE.CNT, performing for said second, third and fourth designated players, the functions that Pref1.OWN.AMT, Pref1.BET.AMT, Pref1.RET.AMT, Pref1.BET.COL, Pref1.RED.CNT, Pref1.BLUE.CNT perform for the designated first player. Operation goes to section 1700 if GAM.CNT is set to 1, 1800 if GAM.CNT is set to 2, or 1900 if GAM.CNT is set to 3.

Flow-chart section 1700 illustrates the chip distribution process when GAM.CNT is set to 1, indicating that players are paid by position. Starting from the designated first player Pref1, each winner is paid from the bank, in rotation, an amount equal to the amount wagered until the amount in said bank is depleted or all players are paid in full.

For the designated first player: The amount won is stored in Pref1.WIN.AMT. Subroutines DRAW-RED and DRAW-BLUE are called to draw in column Pref1.WIN.COL, a number of red and blue chips corresponding to the amount won by said player, and subroutine DELETE-CHIP is called to erase from columns BK.COL1 and BK.COL2, a corresponding number of red and blue chips.

For the designated second, third and fourth players, the process is similar with Pref2.WIN.AMT and Pref2.WIN.COL, Pref3.WIN.AMT and Pref3.WIN.COL, Pref4.WIN.AMT and Pref4.WIN.COL, performing for said second, third and fourth players, the functions that Pref1.WIN.AMT and Pref1.WIN.COL perform said first player.

Any amount remaining in the bank after all winners are paid is refunded to the losing players. Starting from the designated last player Pref4, each loser is paid from the bank, in rotation, an amount equal to the amount wagered until the amount in said bank is depleted.

For the designated fourth player: The amount refunded is stored in Pref4.RET.AMT. Subroutines DRAW-RED and DRAW-BLUE are called to draw in column Pref4.BET.COL, a number of red and blue chips corresponding to the amount refunded to said player, and subroutine DELETE-CHIP is called to erase from columns BK.COL1 and BK.COL2, a corresponding number of red and blue chips.

For the third, second and first players, the process is similar with Pref3.RET.AMT and Pref3.BET.COL, Pref2.RET.AMT and Pref2.BET.COL, Pref1.RET.AMT and Pref1.BET.COL, performing for said third, second and first players, the functions that Pref4.RET.AMT and Pref4.BET.COL perform for said fourth player. Operation goes to section 2200.

Flow-chart section 1800 illustrates the chip distribution process when GAM.CNT is set to 2, indicating that players are paid by percentage. The total lost by all losers is copied into TOT.LOST, and the total amount won by all winners is accumulated into TOT.WIN.

If the amount in the bank is less than the total amount won, each winner receives a partial payment from the bank that is proportional to the amount wagered and inversely proportional to the amount wagered by the other winners, P..WIN.AMT=P..BET.AMT×BK.TOT.AMT/TOT.WIN.

If the amount in the bank is greater or equal to the total amount won, all winners receive full payment from the bank, P..WIN.AMT=P..BET.AMT. The amount remaining in the bank after all winners are paid is refunded to the losing players in P..RET.AMT, with each receiving an amount that is proportional to the amount wagered and inversely proportional to the amount wagered by the other losing players.

The designated first, second, third and fourth players receive the amount won in Pref1.WIN.AMT, Pref2.WIN.AMT, Pref3.WIN.AMT and Pref4.WIN.AMT respectively, and the amount refunded in Pref1.RET.AMT, Pref2.RET.AMT, Pref3.RET.AMT and Pref4.RET.AMT respectively. Subroutines Draw-red and Draw-blue are called to draw on Pref1.WIN.COL, Pref2.WIN.COL, Pref3.WIN.COL and Pref4.WIN.COL, the number of red and blue chips won by said first, second, third and fourth players respectively, then on Pref1.BET.COL, Pref2.BET.COL, Pref3.BET.COL and Pref4.BET.COL, the number of red and blue chips refunded to said players respectifely. Subroutine DELETE-CHIP is then called to erase the chips displayed on columns BK.COL1 and BK.COL2. Operation goes to section 2200.

Flow-chart section 1900 illustrates the chip distribution process when GAM.CNT is set to 3, indicating that players are paid by increment. Starting from the designated first player, each winner receives sequentially from the bank, an amount equal to the value of a blue chip, BLUE.VAL, until each said winner is paid in full, P..WIN.AMT=P..BET.AMT or the bank is depleted. When a player is paid in full, the P..WIN.FLG associated with said player is turned off.

Any amount remaining in the bank after all winners are paid is refunded to the losing players. The losing player with the greatest loss to the bank receives from said bank in P..RET.AMT, an amount reducing his loss to the level of the lost sustained by the losing player with the second greatest loss. Those two players in turn receive from said bank in P..RET.AMT, an amount reducing their loss to the level of the lost sustained by the losing player with the third greatest loss. This process is repeated until the amount lost by all losing players is the same. Then, starting from the designated last player, each player receives from the bank, in rotation, the value of a blue chip BLUE.VAL until the bank is depleted.

For the designated first player: The amount won is stored in Pref1.WIN.AMT, and the amount refunded in Pref1.RET.AMT. Subroutines DRAW-RED and DRAW-BLUE are called to draw in column Pref1.WIN.COL, a number of red and blue chips corresponding to the amount won, and on column Pref1.BET.COL, a number of red and blue chips corresponding to the amount refunded. Subroutine DELETE-CHIP is also called to erase from columns BK.COL1 and BK.COL2, a number of red and blue chips corresponding to the amount in Pref1.WIN.AMT and Pref1.RET.AMT.

For the designated second, third and fourth players, the process is similar with Pref2.WIN.AMT, Pref2.RET.AMT, Pref2.WIN.COL, Pref2.BET.COL; Pref3.WIN.AMT, Pref3.RET.AMT, Pref3.WIN.COL, Pref3.BET.COL;

Pref4.WIN.AMT, Pref4.RET.AMT, Pref4.WIN.COL, Pref4.BET.COL, performing for said second, third and fourth players, the functions that Pref1.WIN.AMT, Pref1.RET.AMT, Pref1.WIN.COL, Pref1.BET.COL perform for the designated first player. Operation goes to section 2200.

Flow-chart section 2000 illustrates the chip collection and distribution process when GAM.CNT is set to 4, indicating that higher ranked players are paid in descending order from lower ranked players in ascending order. A selection menu is displayed, prompting the dealer to enter for each player, a number corresponding to the total points of their cards. That number is displayed in P1.STATUS line for player one, P2.STATUS line for player two, P3.STATUS line for player three and P4.STATUS line for player four. Starting from the designated first player, the players are then sorted in ascending order based on the number entered for them and/or the proximity of that number to the target number for the game, so that pointer ind1 points to the highest ranked player and pointer ind4 points to the lowest ranked player. The number entered for the first ranked player is stored in counter Pind1.RK, the number for the second ranked player in Pind2.RK, the number for the third ranked player in Pind3.RK, and the number for the fourth ranked player in counter Pind4.RK. Ranking numbers are assigned based on the content of counter Z. Assuming that every player is a potential loser, SHADOW-CHIP function is called to alter the chips displayed in the BET.COL associated with all players.

The first ranked player, Pind1, receives from the last ranked player, Pind4, an amount equal to that wagered in Pind1.BET.AMT, to the extend possible, providing that the number in Pind1.RK is not the same as the number in Pind4.RK. If the amount wagered by said fourth ranked player is not sufficient, said first ranked player receives the balance from the third, then second ranked players, to the extend possible, under the same conditions. In each instance, the number in Pind1.RK is compared to the number in similar counter for the other players to prevent the first ranked player from collecting from another player with the same assigned number. The second and third ranked players receive payment from the lower ranked players in the same manner. The amount or portion of the amount wagered by a player in P..BET.AMT that is not lost to another player is refunded in P..RET.AMT. The designated first, second, third and fourth players receive the amount won in Pref1.WIN.AMT, Pref2.WIN.AMT, Pref3.WIN.AMT and Pref4.WIN.AMT respectively, and the amount refunded in Pref1.RET.AMT, Pref2.RET.AMT, Pref3.RET.AMT and Pref4.RET.AMT respectively. Subroutines Draw-red and Draw-blue are called to draw on Pref1.WIN.COL, Pref2.WIN.COL, Pref3.WIN.COL and Pref4.WIN.COL, the number of red and blue chips won by said first, second, third and fourth players respectively, then on Pref1.BET.COL, Pref2.BET.COL, Pref3.BET.COL and Pref4.BET.COL, the number of red and blue chips refunded to said players respectively. Operation goes to section 2200.

Flow-chart section 2100 illustrates the chip collection and distribution process when GAM.CNT is set to 5 or 6, indicating that players wager against a bank representing one or more bankers. A selection menu is displayed, prompting the dealer to make a win, lose or tie selection for each player who wagered against the bank, setting a win, lose or tie flag for each said player. The wager of each said player is processed, sequentially, starting from the designated first player Pref1.

For the first designated player:

If a tie selection is made for said player, the amount wagered in Pref1.BET.AMT is transferred to Pref1.RET.AMT, a yellow marking is displayed in P1.STATUS line, and subroutine DELETE-CHIP is called to erase the chips displayed in column Pref1.BET.COL.

If a win selection is made for said player, a green marking is displayed in P1.STATUS line, and said player receives in Pref1.WIN.AMT, the amount won from the bank which is equal to the amount wagered, to the extend that there is money in the bank, and the amount wagered in Pref1.BET.AMT is transferred to Pref1.RET.AMT. The amount lost by the bank is recorded in counter X.AMT, and that amount is deducted from the amount wagered by the first banker in Bref1.BET.AMT, to the extend possible, then from the amount wagered by the other bankers, in sequence. Subroutines DRAW-RED and DRAW-BLUE are called to draw in column Pref1.WIN.COL, a number of red and blue chips corresponding to the amount won by said player, and subroutine DELETE-CHIP is called to erase from bank columns BK.COL1 and BK.COL2, a corresponding number of red and blue chips. The chips identified with the first designated banker Bref1 are deleted first, then those identified with the second, third and fourth bankers are deleted, in sequence.

If a lose selection is made for said player, a red marking is displayed in P1.STATUS line, and SHADOW-CHIP function is called to alter the chips displayed on Pref1.BET.COL.

The amount wagered by said player, or any portion of it that corresponds to the amount in the bank, is transferred from Pref1.BET.AMT to counter X.AMT, and any amount remaining in Pref1.BET.AMT is transferred to Pref1.RET.AMT. Subroutines DRAW-RED and DRAW-BLUE are called to draw on Pref1.BET.COL, the number of red and blue chips corresponding to the amount refunded to said player. The amount lost to the bank in X.AMT is awarded to the first banker in Bref1.WIN.AMT, to the extend that said amount is matched by the wager of said banker in Bref1.BET.AMT. A corresponding amount is also transferred from the amount wagered by said banker in Bref1.BET.AMT to Bref1.RET.AMT. Subroutines DRAW-RED and DRAW-BLUE are called to draw on column Bref1.BET.COL, the number of red and blue chips corresponding to the amount refunded to said banker, as indicated by the content of Bref1.RET.AMT, and on column Bref1.WIN.AMT, the number of red and blue chips corresponding to the amount won by said player, as indicated by the content of Bref1.WIN.AMT. Subroutine DELETE-CHIP is also called to erase from columns BK.COL1 and BK.COL2, the number of red and blue chips corresponding to the amount refunded to said banker. In the first said banker does not have enough money in the bank to cover the amount lost by said player, the remaining portion of that amount is awarded to the other bankers, in sequence, under similar conditions.

The selection process involving the second, third and fourth designated players is similar, with Pref2.BET.AMT, Pref2.WIN.AMT, Pref2.RET.AMT, Pref2.BET.COL, Pref2.WIN.COL; Pref3.BET.AMT, Pref3.WIN.AMT, Pref3.RET.AMT, Pref3.BET.COL, Pref3.WIN.COL; Pref4.BET.AMT, Pref4.WIN.AMT, Pref4.RET.AMT, Pref4.BET.COL, Pref4.WIN.COL, performing for said second, third and fourth designated players, the same functions that Pref1.BET.AMT, Pref1.WIN.AMT, Pref1.RET.AMT, Pref1.BET.COL, Pref1.WIN.COL perform for said first designated player.

After the wager of all players has been processed, any amount remaining in the bank is refunded to the bankers, starting from the designated last banker. Said banker receives from BK.TOT.AMT in Bref4.RET.AMT, an amount equal to that in Bref4.BET.AMT, to the extend possible. Subroutines DRAW-RED and DRAW-BLUE are called to draw on column Bref4.BET.COL, the number of red and blue chips corresponding to the amount refunded to said banker, as indicated by Bref4.RET.AMT, and subroutine DELETE-CHIP is also called to erase from columns BK.COL1 and BK.COL2, a corresponding number of red and blue chips.

The refund process involving the third, second and first bankers is similar with Bref3.BET.AMT, Bref3.RET.AMT, Bref3.BET.COL; Bref2.BET.AMT, Bref2.RET.AMT, Bref2.BET.COL; Bref1.BET.AMT, Bref1.RET.AMT, Bref1.BET.COL, performing for said third, second and first bankers, the same functions that Bref4.BET.AMT, Bref4.RET.AMT, Bref4.BET.COL perform for said fourth designated banker. Operation then goes to section 2200.

Flow-chart section 2200 illustrates the process that takes place when the END.GAME key is pressed by the dealer, ending the game. The amount won by each player in P..WIN.AMT and the amount refunded to each said player in P..RET.AMT are added to the amount belonging to each said player in P.. OWN.AMT. All the bet and win display columns are then cleared. Operation then returns to section 1000 and the main selection menu is displayed.

If the REPEAT.GAM key is pressed, the amount won and refunded to all players is automatically returned to the bank and the counters storing the amount wagered by all players, and subroutines DRAW-RED and DRAW-BLUE are called repeatedly to draw the corresponding number of red and blue chips wagered on the bet columns associated with said players and said bank. The mirror copy of game variables P..BET.AMT, P..WIN.AMT, P..RET.AMT, P..RED.CNT, P..BLUE.CNT, P..BK.FLG, P..REQ.FLG, P..TIE.FLG, P..WIN.FLG and P..LOSE.FLG are used to restore the game to its original condition before the win/lose selection was made. The dealer is then prompted to select the option of restoring the original win/lose selection or making a new win/lose selection for the players. If the former option is selected, the amount originally won and refunded to all players is again dispersed to said players, and subroutines DRAW-RED, DRAW-BLUE and DELETE-CHIP are called to draw and erase chips as required, with the mirror copy of the game variables used to restore the game to its original condition. If the latter option is selected, a new win/lose selection is made for the players and the chips wagered are distributed accordingly. A new game gets underway, when the START.GEM key is pressed.

Each time a player presses a key to increase or decrease the amount of his wager, and each time an amount is won or refunded to a player, the numeric LCD display associated with said player is updated accordingly. Referring to the drawing illustrated in FIG. 3, a string of signals is sent, via output T5, to LCD display 310 to decrease the amount indicated, each time a bet is made by player one, and a string of signals is sent, via output T1, to said LCD display to increase the amount indicated, each time an amount is awarded to said player. Similarly, a string of signals is set, via outputs T6, T7 and T8, to LCD displays 320, 340 and 350 associated with players two, three and four, to decrease the amount indicated, and a string of signals is sent, via outputs T2, T3 and T4, to said LCD displays to increase the amount indicated.

In the text, reference has been made to writing on the chips displayed in the bank, a unique number or marking identifying the player they are associated with. In an alternate arrangement, a line is draws between stacks of chips associated with different players, and an identifying number is written on or about that line.

In the text, reference has also been made to one video monitor for displaying the computer-generated graphic likeness of poker chips. In practice, two or more video monitors situated side by side may be used. For instance the first video monitor may display chips wagered and won by a number of players, while a second monitor displays chips wagered and won by other players. The arrangements permitting two or more video monitors to be controlled from one CPU are well known.

From the logic illustrated, the actual computer programs and codes to operate the system and methods described can be generated by anyone skilled in the art. Those computer programs and codes are not part of the invention, except as produced to operate the system as described.

There will now be obvious to those skilled in the art many modifications and variations of the systems and methods set forth above. These modifications and variations will not depart from the scope of the invention as defined by the following claims.

What is claimed is:

1. A gaming table for playing cards thereon comprising:

a computer means for generating graphic likeness of poker chips;

a video monitor means graphically divided into display sections associated with said players and a bank, on which said graphic likeness of poker chips can be displayed;

a plurality of manually operated switch means associated with said players;

a plurality of manually operated switch means associated with a dealer wherein:

said computer means, monitor means, player-associated switch means and dealer-associated switch means being linked in such a way that:

a Start Bet switch means associated with said dealer enables the switch means associated with all said players;

a Bet switch means associated with a player causes the generation of a graphic likeness of poker chip by said computer means, and the display of said graphic likeness of poker chip in the display section associated with said player, adjacent to the graphic likeness of poker chips previously generated by said Bet switch means, with the monetary value of said graphic likeness of poker chip deducted from the amount belonging to said player;

a Cancel Bet switch means associated with a player causes the elimination by said computer means of one or all of the graphic likeness of poker chips associates with said player, and the erasure of said graphic likeness of poker chip(s) from said video monitor means, with the monetary value of said graphic likeness of poker chip(s) added to the amount belonging to said player;

an End Bet switch means associated with said dealer disables the switch means associated with all said players, and enables a Player Selection switch means associated with said dealer;

a Player Selection switch means associated with said dealer allows for the selection of the player for whom a status selection is to be made, and enables a Status Selection switch means associated with said dealer;

a Status Selection switch means associated with said dealer allows for a win, lose or tie status selection for said selected player, and re-enables said Player Selection switch means when a status selection has not been made for all players with graphic likeness of poker chips in a player-associated display section, or enables an End Game switch means to end the current game when a status selection has been made for all players with graphic likeness of poker chips in a player-associated display section.

2. A gaming table as claimed in claim 1 in which the number of graphic likeness of poker chips wagered by a player is totally independent of the number of graphic likeness of poker chips wagered by any other player, and limited only by the amount belonging to said player, the display capacity of the display section associated with said player, and the maximum bet amount set for the game.

3. A gaming table as claimed in claim 2 in which a lose selection made for a player results in the transfer of some or all the graphic likeness of poker chips associated with said player, from the display section associated with said player, to the display section associated with said bank or the display section associated with another player.

4. A gaming table as claimed in claim 3 in which a win selection made for a player results in the transfer of graphic likeness of poker chips from the display section associated with said bank, to the display section associated with said player.

5. A gaming table as claimed in claim 4 in which a win, lose or tie selection made for a player is visually indicated in the display section associated with said player.

6. A gaming table as claimed in claim 5 in which the graphic likeness of poker chips won by a winner are distinguishable from the graphic likeness of poker chips wagered by said player, within the display section associated with said player.

7. A gaming table as claimed in claim 6 in which said display sections can display graphic likeness of poker chips of different denominations that are distinguishable by differences in size, color or design.

8. A gaming table as claimed in claim 7 in which one of the switch means associated with a player causes the generation of graphic likeness of poker chips of a different denomination.

9. A gaming table as claimed in claim 8 in which a number of graphic likeness of poker chips of one denomination are automatically converted into graphic likeness of poker chips of another denomination.

10. A gaming table as claimed in claim 9 in which the graphic likeness of poker chips remaining in the display section associated with said bank after a win, lose or tie selection has been made for all active players are automatically transferred to the display section associated with the player with whom they are associated.

11. A gaming table as claimed in claim 10 in which one of the switch means associated with a player allows for the selection of a display section other than the display section associated with said player, for the display of the graphic likeness of poker chips associated with said player.

12. A gaming table as claimed in claim 11 in which a display section associated with or selected by a player displays a unique number or marking identifying the player it is associated with, or the graphic likeness of poker chips displayed thereon contain a unique marking identifying the player they are associated with.

13. A gaming table as claimed in claim 12 in which the monetary value of the graphic likeness of poker chips won or lost by a player is indicated in the display section associated with or selected by said player, at the end of each game.

14. A gaming table as claimed in claim 13 in which the amount belonging to a player is indicated in the display section associated with or selected by said player, or in a separate numeric display means associated with said player.

15. A gaming table as claimed in claim 14 in which one of the switch means associated with said dealer allows for the replay of a game, for the purpose of showing how the game was played, or for the purpose of allowing for the making of a different win, lose or tie selection for any player.

16. A gaming table as claimed in claim 15 in which some of the switch means associated with said dealer allow for the selection of game operational data, and for financial transactions with said players.

* * * * *